US008648752B2

(12) United States Patent
Ramachandran et al.

(10) Patent No.: US 8,648,752 B2
(45) Date of Patent: Feb. 11, 2014

(54) CHASSIS-EXCITED ANTENNA APPARATUS AND METHODS

(75) Inventors: Prasadh Ramachandran, Kempele (FI); Petteri Annamaa, Oulunsalo (FI)

(73) Assignee: Pulse Finland Oy, Kempele (FI)

( * ) Notice: Subject to any disclaimer, the term of this patent is extended or adjusted under 35 U.S.C. 154(b) by 291 days.

(21) Appl. No.: 13/026,078

(22) Filed: Feb. 11, 2011

(65) Prior Publication Data

US 2012/0206302 A1 Aug. 16, 2012

(51) Int. Cl.
*H01Q 1/24* (2006.01)
*H01Q 5/00* (2006.01)

(52) U.S. Cl.
USPC ..... 343/702; 343/700 MS

(58) Field of Classification Search
USPC ..... 343/702, 700 MS, 872, 878
See application file for complete search history.

(56) References Cited

U.S. PATENT DOCUMENTS

| | | | |
|---|---|---|---|
| 2,745,102 | A | 5/1956 | Norgorden |
| 3,938,161 | A | 2/1976 | Sanford |
| 4,004,228 | A | 1/1977 | Mullett |
| 4,028,652 | A | 6/1977 | Wakino et al. |
| 4,031,468 | A | 6/1977 | Ziebell et al. |
| 4,054,874 | A | 10/1977 | Oltman |
| 4,069,483 | A | 1/1978 | Kaloi |
| 4,123,756 | A | 10/1978 | Nagata et al. |
| 4,123,758 | A | 10/1978 | Shibano et al. |
| 4,131,893 | A | 12/1978 | Munson et al. |
| 4,201,960 | A | 5/1980 | Skutta et al. |
| 4,255,729 | A | 3/1981 | Fukasawa et al. |
| 4,313,121 | A | 1/1982 | Campbell et al. |
| 4,356,492 | A | 10/1982 | Kaloi |
| 4,370,657 | A | 1/1983 | Kaloi |
| 4,423,396 | A | 12/1983 | Makimoto et al. |
| 4,431,977 | A | 2/1984 | Sokola et al. |
| 4,546,357 | A | 10/1985 | Laughon et al. |
| 4,559,508 | A | 12/1985 | Nishikawa et al. |
| 4,625,212 | A | 11/1986 | Oda et al. |

(Continued)

FOREIGN PATENT DOCUMENTS

| | | |
|---|---|---|
| CN | 1316797 | 10/2007 |
| DE | 10015583 | 11/2000 |

(Continued)

OTHER PUBLICATIONS ("Slot line on a Dielectric Substrate" IEEE Transactions on Microwave Theory and Techniques;Cohn, S.B; Oct. 1969).*

(Continued)

*Primary Examiner* — Jerome Jackson, Jr.
*Assistant Examiner* — Ricardo Magallanes
(74) *Attorney, Agent, or Firm* — Gazdzinski & Associates, PC

(57) ABSTRACT

A chassis-excited antenna apparatus, and methods of tuning and utilizing the same. In one embodiment, a distributed loop antenna configuration is used within a handheld mobile device (e.g., cellular telephone). The antenna comprises two radiating elements: one configured to operate in a high-frequency band, and the other in a low-frequency band. The two antenna elements are disposed on different side surfaces of the metal chassis of the portable device; e.g., on the opposing sides of the device enclosure. Each antenna component comprises a radiator and an insulating cover. The radiator is coupled to a device feed via a feed conductor and a ground point. A portion of the feed conductor is disposed with the radiator to facilitate forming of the coupled loop resonator structure.

27 Claims, 10 Drawing Sheets

(56) References Cited

U.S. PATENT DOCUMENTS 4,652,889 A 3/1987 Bizouard et al.
4,661,992 A 4/1987 Garay et al.
4,692,726 A 9/1987 Green et al.
4,703,291 A 10/1987 Nishikawa et al.
4,706,050 A 11/1987 Andrews
4,716,391 A 12/1987 Moutrie et al.
4,740,765 A 4/1988 Ishikawa et al.
4,742,562 A 5/1988 Kommrusch
4,761,624 A 8/1988 Igarashi et al.
4,800,348 A 1/1989 Rosar et al.
4,800,392 A 1/1989 Garay et al.
4,821,006 A 4/1989 Ishikawa et al.
4,823,098 A 4/1989 DeMuro et al.
4,827,266 A 5/1989 Sato et al.
4,829,274 A 5/1989 Green et al.
4,862,181 A 8/1989 PonceDeLeon et al.
4,879,533 A 11/1989 De Muro et al.
4,896,124 A 1/1990 Schwent
4,954,796 A 9/1990 Green et al.
4,965,537 A 10/1990 Kommrusch
4,977,383 A 12/1990 Niiranen
4,980,694 A 12/1990 Hines
5,017,932 A 5/1991 Ushiyama et al.
5,047,739 A 9/1991 Kuokkanene
5,053,786 A 10/1991 Silverman et al.
5,097,236 A 3/1992 Wakino et al.
5,103,197 A 4/1992 Turunen
5,109,536 A 4/1992 Kommrusch
5,155,493 A 10/1992 Thursby et al.
5,157,363 A 10/1992 Puurunen
5,159,303 A 10/1992 Flink
5,166,697 A 11/1992 Viladevall et al.
5,170,173 A 12/1992 Krenz et al.
5,203,021 A 4/1993 Repplinger et al.
5,210,510 A 5/1993 Karsikas
5,210,542 A 5/1993 Pett et al.
5,220,335 A 6/1993 Huang
5,229,777 A 7/1993 Doyle
5,239,279 A 8/1993 Turunen
5,278,528 A 1/1994 Turunen
5,281,326 A 1/1994 Galla
5,298,873 A 3/1994 Ala-Kojola
5,302,924 A 4/1994 Jantunen
5,304,968 A 4/1994 Ohtonen
5,307,036 A 4/1994 Turunen
5,319,328 A 6/1994 Turunen
5,349,315 A 9/1994 Ala-Kojola
5,349,700 A 9/1994 Parker
5,351,023 A 9/1994 Niiranen
5,354,463 A 10/1994 Turunen
5,355,142 A 10/1994 Marshall et al.
5,357,262 A 10/1994 Blaese
5,363,114 A 11/1994 Shoemaker
5,369,782 A 11/1994 Kawano et al.
5,382,959 A 1/1995 Pett et al.
5,386,214 A 1/1995 Sugawara
5,387,886 A 2/1995 Takalo
5,394,162 A 2/1995 Korovesis et al.
RE34,898 E 4/1995 Turunen
5,408,206 A 4/1995 Turunen
5,418,508 A 5/1995 Puurunen
5,432,489 A 7/1995 Yrjola
5,438,697 A 8/1995 Fowler et al.
5,440,315 A 8/1995 Wright et al.
5,442,366 A 8/1995 Sanford
5,444,453 A 8/1995 Lalezari
5,467,065 A 11/1995 Turunen
5,473,295 A 12/1995 Turunen
5,506,554 A 4/1996 Ala-Kojola
5,508,668 A 4/1996 Prokkola
5,510,802 A 4/1996 Tsuru et al.
5,517,683 A 5/1996 Collett et al.
5,521,561 A 5/1996 Yrjola
5,532,703 A 7/1996 Stephens et al.
5,541,560 A 7/1996 Turunen
5,541,617 A 7/1996 Connolly et al.
5,543,764 A 8/1996 Turunen
5,550,519 A 8/1996 Korpela
5,557,287 A 9/1996 Pottala et al.
5,557,292 A 9/1996 Nygren et al.
5,570,071 A 10/1996 Ervasti
5,585,771 A 12/1996 Ervasti
5,585,810 A 12/1996 Tsuru et al.
5,589,844 A 12/1996 Belcher et al.
5,594,395 A 1/1997 Niiranen
5,604,471 A 2/1997 Rattila
5,627,502 A 5/1997 Ervasti
5,649,316 A 7/1997 Prudhomme et al.
5,668,561 A 9/1997 Perrotta et al.
5,675,301 A 10/1997 Nappa
5,689,221 A 11/1997 Niiranen
5,694,135 A 12/1997 Dikun et al.
5,703,600 A 12/1997 Burrell et al.
5,709,832 A 1/1998 Hayes et al.
5,711,014 A 1/1998 Crowley et al.
5,717,368 A 2/1998 Niiranen
5,731,749 A 3/1998 Yrjola
5,734,305 A 3/1998 Ervasti
5,734,350 A 3/1998 Deming et al.
5,734,351 A 3/1998 Ojantakanen
5,739,735 A 4/1998 Pyykko
5,742,259 A 4/1998 Annamaa
5,757,327 A 5/1998 Yajima et al.
5,764,190 A 6/1998 Murch et al.
5,767,809 A 6/1998 Chuang et al.
5,768,217 A 6/1998 Sonoda et al.
5,777,581 A 7/1998 Lilly et al.
5,777,585 A 7/1998 Tsuda et al.
5,793,269 A 8/1998 Ervasti
5,812,094 A 9/1998 Maldonado
5,815,048 A 9/1998 Ala-Kojola
5,822,705 A 10/1998 Lehtola
5,852,421 A 12/1998 Maldonado
5,861,854 A 1/1999 Kawahata et al.
5,874,926 A 2/1999 Tsuru et al.
5,880,697 A 3/1999 McCarrick et al.
5,886,668 A 3/1999 Pedersen et al.
5,892,490 A 4/1999 Asakura et al.
5,903,820 A 5/1999 Hagstrom
5,905,475 A 5/1999 Annamaa
5,920,290 A 7/1999 McDonough et al.
5,926,139 A 7/1999 Korisch
5,929,813 A 7/1999 Eggleston
5,936,583 A 8/1999 Sekine et al.
5,943,016 A 8/1999 Snyder, Jr. et al.
5,952,975 A 9/1999 Pedersen et al.
5,959,583 A 9/1999 Funk
5,963,180 A 10/1999 Leisten
5,966,097 A 10/1999 Fukasawa et al.
5,970,393 A 10/1999 Khorrami et al.
5,977,710 A 11/1999 Kuramoto et al.
5,986,606 A 11/1999 Kossiavas et al.
5,986,608 A 11/1999 Korisch et al.
5,990,848 A 11/1999 Annamaa
5,999,132 A 12/1999 Kitchener et al.
6,005,529 A 12/1999 Hutchinson
6,006,419 A 12/1999 Vandendolder et al.
6,008,764 A 12/1999 Ollikainen
6,009,311 A 12/1999 Killion et al.
6,014,106 A 1/2000 Annamaa
6,016,130 A 1/2000 Annamaa
6,023,608 A 2/2000 Yrjola
6,031,496 A 2/2000 Kuittinen et al.
6,034,637 A 3/2000 McCoy et al.
6,037,848 A 3/2000 Alila
6,043,780 A 3/2000 Funk et al.
6,072,434 A 6/2000 Papatheodorou
6,078,231 A 6/2000 Pelkonen
6,091,363 A 7/2000 Komatsu et al.
6,097,345 A 8/2000 Walton
6,100,849 A 8/2000 Tsubaki et al.
6,112,108 A 8/2000 Crowley et al.
6,133,879 A 10/2000 Grangeat et al.
6,134,421 A 10/2000 Lee et al.

(56) References Cited

U.S. PATENT DOCUMENTS

| | | | |
|---|---|---|---|
| 6,140,973 | A | 10/2000 | Annamaa |
| 6,147,650 | A | 11/2000 | Kawahata et al. |
| 6,157,819 | A | 12/2000 | Vuokko |
| 6,177,908 | B1 | 1/2001 | Kawahata |
| 6,185,434 | B1 | 2/2001 | Hagstrom |
| 6,190,942 | B1 | 2/2001 | Wilm et al. |
| 6,195,049 | B1 | 2/2001 | Kim et al. |
| 6,204,826 | B1 | 3/2001 | Rutkowski et al. |
| 6,215,376 | B1 | 4/2001 | Hagstrom |
| 6,246,368 | B1 | 6/2001 | Deming et al. |
| 6,252,552 | B1 | 6/2001 | Tarvas et al. |
| 6,252,554 | B1 | 6/2001 | Isohatala |
| 6,255,994 | B1 | 7/2001 | Saito |
| 6,268,831 | B1 | 7/2001 | Sanford |
| 6,295,029 | B1 | 9/2001 | Chen et al. |
| 6,297,776 | B1 | 10/2001 | Pankinaho |
| 6,304,220 | B1 | 10/2001 | Herve et al. |
| 6,308,720 | B1 | 10/2001 | Modi |
| 6,316,975 | B1 | 11/2001 | O'Toole et al. |
| 6,323,811 | B1 | 11/2001 | Tsubaki |
| 6,326,921 | B1 | 12/2001 | Egorov et al. |
| 6,337,663 | B1 | 1/2002 | Chi-Ming |
| 6,340,954 | B1 | 1/2002 | Annamaa et al. |
| 6,342,859 | B1 | 1/2002 | Kurz et al. |
| 6,346,914 | B1 | 2/2002 | Annamaa |
| 6,348,892 | B1 | 2/2002 | Annamaa |
| 6,353,443 | B1 | 3/2002 | Ying |
| 6,366,243 | B1 | 4/2002 | Isohatala |
| 6,377,827 | B1 | 4/2002 | Rydbeck |
| 6,380,905 | B1 | 4/2002 | Annamaa |
| 6,396,444 | B1 | 5/2002 | Goward |
| 6,404,394 | B1 | 6/2002 | Hill |
| 6,417,813 | B1 | 7/2002 | Durham |
| 6,423,915 | B1 | 7/2002 | Winter |
| 6,429,818 | B1 | 8/2002 | Johnson et al. |
| 6,452,551 | B1 | 9/2002 | Chen |
| 6,452,558 | B1 | 9/2002 | Saitou et al. |
| 6,456,249 | B1 | 9/2002 | Johnson et al. |
| 6,459,413 | B1 | 10/2002 | Tseng et al. |
| 6,462,716 | B1 | 10/2002 | Kushihi |
| 6,469,673 | B2 | 10/2002 | Kaiponen |
| 6,473,056 | B2 | 10/2002 | Annamaa |
| 6,476,769 | B1 | 11/2002 | Lehtola |
| 6,480,155 | B1 | 11/2002 | Eggleston |
| 6,501,425 | B1 | 12/2002 | Nagumo |
| 6,518,925 | B1 | 2/2003 | Annamaa |
| 6,529,168 | B2 | 3/2003 | Mikkola |
| 6,535,170 | B2 | 3/2003 | Sawamura et al. |
| 6,538,604 | B1 | 3/2003 | Isohatala |
| 6,549,167 | B1 | 4/2003 | Yoon |
| 6,556,812 | B1 | 4/2003 | Pennanen et al. |
| 6,566,944 | B1 | 5/2003 | Pehlke |
| 6,580,396 | B2 | 6/2003 | Lin |
| 6,580,397 | B2 | 6/2003 | Lindell |
| 6,600,449 | B2 | 7/2003 | Onaka |
| 6,603,430 | B1 | 8/2003 | Hill et al. |
| 6,606,016 | B2 | 8/2003 | Takamine et al. |
| 6,611,235 | B2 | 8/2003 | Barna et al. |
| 6,614,400 | B2 | 9/2003 | Egorov |
| 6,614,405 | B1 | 9/2003 | Mikkonen |
| 6,634,564 | B2 | 10/2003 | Kuramochi |
| 6,636,181 | B2 | 10/2003 | Asano |
| 6,639,564 | B2 | 10/2003 | Johnson |
| 6,646,606 | B2 | 11/2003 | Mikkola |
| 6,650,295 | B2 | 11/2003 | Ollikainen et al. |
| 6,657,593 | B2 | 12/2003 | Nagumo et al. |
| 6,657,595 | B1 | 12/2003 | Phillips et al. |
| 6,670,926 | B2 | 12/2003 | Miyasaka |
| 6,677,903 | B2 | 1/2004 | Wang |
| 6,683,573 | B2 | 1/2004 | Park |
| 6,693,594 | B2 | 2/2004 | Pankinaho et al. |
| 6,717,551 | B1 | 4/2004 | Desclos et al. |
| 6,727,857 | B2 | 4/2004 | Mikkola |
| 6,734,825 | B1 | 5/2004 | Guo et al. |
| 6,734,826 | B1 | 5/2004 | Dai et al. |
| 6,738,022 | B2 | 5/2004 | Klaavo et al. |
| 6,741,214 | B1 | 5/2004 | Kadambi et al. |
| 6,753,813 | B2 | 6/2004 | Kushihi |
| 6,759,989 | B2 | 7/2004 | Tarvas et al. |
| 6,765,536 | B2 | 7/2004 | Phillips et al. |
| 6,774,853 | B2 | 8/2004 | Wong et al. |
| 6,781,545 | B2 | 8/2004 | Sung |
| 6,801,166 | B2 | 10/2004 | Mikkola |
| 6,801,169 | B1 | 10/2004 | Chang et al. |
| 6,806,835 | B2 | 10/2004 | Iwai |
| 6,819,287 | B2 | 11/2004 | Sullivan et al. |
| 6,819,293 | B2 | 11/2004 | De Graauw |
| 6,825,818 | B2 | 11/2004 | Toncich |
| 6,836,249 | B2 | 12/2004 | Kenoun et al. |
| 6,847,329 | B2 | 1/2005 | Ikegaya et al. |
| 6,856,293 | B2 | 2/2005 | Bordi |
| 6,862,437 | B1 | 3/2005 | McNamara |
| 6,862,441 | B2 | 3/2005 | Ella |
| 6,873,291 | B2 | 3/2005 | Aoyama |
| 6,876,329 | B2 | 4/2005 | Milosavljevic |
| 6,882,317 | B2 | 4/2005 | Koskiniemi |
| 6,891,507 | B2 | 5/2005 | Kushihi et al. |
| 6,897,810 | B2 | 5/2005 | Dai et al. |
| 6,900,768 | B2 | 5/2005 | Iguchi et al. |
| 6,903,692 | B2 | 6/2005 | Kivekas |
| 6,911,945 | B2 | 6/2005 | Korva |
| 6,922,171 | B2 | 7/2005 | Annamaa |
| 6,925,689 | B2 | 8/2005 | Folkmar |
| 6,927,729 | B2 | 8/2005 | Legay |
| 6,937,196 | B2 | 8/2005 | Korva |
| 6,950,066 | B2 | 9/2005 | Hendler et al. |
| 6,950,068 | B2 | 9/2005 | Bordi |
| 6,952,144 | B2 | 10/2005 | Javor |
| 6,952,187 | B2 | 10/2005 | Annamaa |
| 6,958,730 | B2 | 10/2005 | Nagumo et al. |
| 6,961,544 | B1 | 11/2005 | Hagstrom |
| 6,963,308 | B2 | 11/2005 | Korva |
| 6,963,310 | B2 | 11/2005 | Horita et al. |
| 6,967,618 | B2 | 11/2005 | Ojantakanen |
| 6,975,278 | B2 | 12/2005 | Song et al. |
| 6,985,108 | B2 | 1/2006 | Mikkola |
| 6,992,543 | B2 | 1/2006 | Luetzelschwab et al. |
| 6,995,710 | B2 | 2/2006 | Sugimoto et al. |
| 7,023,341 | B2 | 4/2006 | Stilp |
| 7,031,744 | B2 | 4/2006 | Kuriyama et al. |
| 7,042,403 | B2 | 5/2006 | Colburn et al. |
| 7,053,841 | B2 | 5/2006 | Ponce De Leon et al. |
| 7,054,671 | B2 | 5/2006 | Kaiponen et al. |
| 7,057,560 | B2 | 6/2006 | Erkocevic |
| 7,081,857 | B2 | 7/2006 | Kinnunen et al. |
| 7,084,831 | B2 | 8/2006 | Takagi et al. |
| 7,099,690 | B2 | 8/2006 | Milosavljevic |
| 7,113,133 | B2 | 9/2006 | Chen et al. |
| 7,119,749 | B2 | 10/2006 | Miyata et al. |
| 7,126,546 | B2 | 10/2006 | Annamaa |
| 7,136,019 | B2 | 11/2006 | Mikkola |
| 7,136,020 | B2 | 11/2006 | Yamaki |
| 7,142,824 | B2 | 11/2006 | Kojima et al. |
| 7,148,847 | B2 | 12/2006 | Yuanzhu |
| 7,148,849 | B2 | 12/2006 | Lin |
| 7,148,851 | B2 | 12/2006 | Takaki et al. |
| 7,170,464 | B2 | 1/2007 | Tang et al. |
| 7,176,838 | B1 | 2/2007 | Kinezos |
| 7,180,455 | B2 | 2/2007 | Oh et al. |
| 7,193,574 | B2 | 3/2007 | Chiang et al. |
| 7,205,942 | B2 | 4/2007 | Wang et al. |
| 7,218,280 | B2 | 5/2007 | Annamaa |
| 7,218,282 | B2 | 5/2007 | Humpfer et al. |
| 7,224,313 | B2 | 5/2007 | McKinzie, III et al. |
| 7,230,574 | B2 | 6/2007 | Johnson |
| 7,237,318 | B2 | 7/2007 | Annamaa |
| 7,256,743 | B2 | 8/2007 | Korva |
| 7,274,334 | B2 | 9/2007 | O'Riordan et al. |
| 7,283,097 | B2 | 10/2007 | Wen et al. |
| 7,289,064 | B2 | 10/2007 | Cheng |
| 7,292,200 | B2 | 11/2007 | Posluszny et al. |
| 7,319,432 | B2 | 1/2008 | Andersson |
| 7,330,153 | B2 | 2/2008 | Rentz |
| 7,333,067 | B2 | 2/2008 | Hung et al. |

(56) References Cited

U.S. PATENT DOCUMENTS

| | | | | |
|---|---|---|---|---|
| 7,339,528 | B2 | 3/2008 | Wang et al. | |
| 7,340,286 | B2 | 3/2008 | Korva et al. | |
| 7,345,634 | B2 | 3/2008 | Ozkar et al. | |
| 7,352,326 | B2 | 4/2008 | Korva | |
| 7,355,559 | B2 * | 4/2008 | Tikhov et al. | 343/895 |
| 7,358,902 | B2 | 4/2008 | Erkocevic | |
| 7,382,319 | B2 | 6/2008 | Kawahata | |
| 7,385,556 | B2 | 6/2008 | Chung et al. | |
| 7,388,543 | B2 | 6/2008 | Vance | |
| 7,391,378 | B2 | 6/2008 | Mikkola | |
| 7,405,702 | B2 | 7/2008 | Annamaa et al. | |
| 7,417,588 | B2 | 8/2008 | Castany et al. | |
| 7,423,592 | B2 | 9/2008 | Pros et al. | |
| 7,432,860 | B2 | 10/2008 | Huynh | |
| 7,439,929 | B2 | 10/2008 | Ozkar | |
| 7,468,700 | B2 | 12/2008 | Milosavlejevic | |
| 7,468,709 | B2 | 12/2008 | Niemi | |
| 7,498,990 | B2 | 3/2009 | Park et al. | |
| 7,501,983 | B2 | 3/2009 | Mikkola | |
| 7,502,598 | B2 | 3/2009 | Kronberger | |
| 7,564,413 | B2 | 7/2009 | Kim et al. | |
| 7,589,678 | B2 | 9/2009 | Perunka | |
| 7,616,158 | B2 | 11/2009 | Mak et al. | |
| 7,629,931 | B2 * | 12/2009 | Ollikainen | 343/702 |
| 7,633,449 | B2 | 12/2009 | Oh | |
| 7,663,551 | B2 | 2/2010 | Nissinen | |
| 7,671,804 | B2 | 3/2010 | Zhang et al. | |
| 7,679,565 | B2 | 3/2010 | Sorvala | |
| 7,692,543 | B2 | 4/2010 | Copeland | |
| 7,710,325 | B2 | 5/2010 | Cheng | |
| 7,724,204 | B2 | 5/2010 | Annamaa | |
| 7,760,146 | B2 | 7/2010 | Ollikainen | |
| 7,764,245 | B2 | 7/2010 | Loyet | |
| 7,786,938 | B2 | 8/2010 | Sorvala et al. | |
| 7,800,544 | B2 | 9/2010 | Thornell-Pers | |
| 7,830,327 | B2 | 11/2010 | He | |
| 7,889,139 | B2 | 2/2011 | Hobson et al. | |
| 7,889,143 | B2 | 2/2011 | Milosavljevic | |
| 7,901,617 | B2 | 3/2011 | Taylor | |
| 7,916,086 | B2 | 3/2011 | Koskiniemi et al. | |
| 7,963,347 | B2 | 6/2011 | Pabon | |
| 7,973,720 | B2 | 7/2011 | Sorvala | |
| 8,049,670 | B2 | 11/2011 | Jung et al. | |
| 8,179,322 | B2 | 5/2012 | Nissinen | |
| 2001/0050636 | A1 | 12/2001 | Weinberger | |
| 2002/0183013 | A1 | 12/2002 | Auckland et al. | |
| 2002/0196192 | A1 | 12/2002 | Nagumo et al. | |
| 2003/0146873 | A1 | 8/2003 | Blancho | |
| 2004/0090378 | A1 | 5/2004 | Dai et al. | |
| 2004/0145525 | A1 | 7/2004 | Annabi et al. | |
| 2004/0171403 | A1 | 9/2004 | Mikkola | |
| 2005/0057401 | A1 | 3/2005 | Yuanzhu | |
| 2005/0159131 | A1 | 7/2005 | Shibagaki et al. | |
| 2005/0176481 | A1 | 8/2005 | Jeong | |
| 2006/0071857 | A1 | 4/2006 | Pelzer | |
| 2006/0192723 | A1 | 8/2006 | Harada | |
| 2007/0042615 | A1 | 2/2007 | Liao | |
| 2007/0082789 | A1 | 4/2007 | Nissila | |
| 2007/0152881 | A1 | 7/2007 | Chan | |
| 2007/0188388 | A1 | 8/2007 | Feng | |
| 2008/0055164 | A1 | 3/2008 | Zhang et al. | |
| 2008/0059106 | A1 | 3/2008 | Wight | |
| 2008/0088511 | A1 * | 4/2008 | Sorvala et al. | 343/700 MS |
| 2008/0211725 | A1 * | 9/2008 | Ollikainen | 343/749 |
| 2008/0266199 | A1 | 10/2008 | Milosavljevic | |
| 2008/0316116 | A1 * | 12/2008 | Hobson et al. | 343/702 |
| 2009/0009415 | A1 | 1/2009 | Tanska | |
| 2009/0135066 | A1 | 5/2009 | Raappana et al. | |
| 2009/0174604 | A1 | 7/2009 | Keskitalo | |
| 2009/0196160 | A1 | 8/2009 | Crombach | |
| 2009/0197654 | A1 | 8/2009 | Teshima | |
| 2009/0231213 | A1 | 9/2009 | Ishimiya | |
| 2010/0123632 | A1 * | 5/2010 | Hill et al. | 343/702 |
| 2010/0220016 | A1 | 9/2010 | Nissinen | |
| 2010/0231481 | A1 * | 9/2010 | Chiang et al. | 343/898 |
| 2010/0244978 | A1 | 9/2010 | Milosavljevic | |
| 2010/0309092 | A1 | 12/2010 | Lambacka | |
| 2011/0012794 | A1 * | 1/2011 | Schlub et al. | 343/702 |
| 2011/0018776 | A1 * | 1/2011 | Brown | 343/788 |
| 2011/0102290 | A1 | 5/2011 | Milosavljevic | |
| 2011/0133994 | A1 | 6/2011 | Korva | |
| 2012/0119955 | A1 | 5/2012 | Milosavljevic | |

FOREIGN PATENT DOCUMENTS

| | | | |
|---|---|---|---|
| DE | 10104862 | | 8/2002 |
| DE | 101 50 149 | A1 | 4/2003 |
| EP | 0208424 | | 1/1987 |
| EP | 0278069 | | 8/1988 |
| EP | 0279050 | | 8/1988 |
| EP | 0339822 | | 3/1989 |
| EP | 0 332 139 | | 9/1989 |
| EP | 0 376 643 | A2 | 4/1990 |
| EP | 0383292 | | 8/1990 |
| EP | 0399975 | | 12/1990 |
| EP | 0400872 | | 12/1990 |
| EP | 0401839 | | 9/1991 |
| EP | 0447218 | | 9/1994 |
| EP | 0615285 | | 10/1994 |
| EP | 0621653 | | 2/1995 |
| EP | 0 749 214 | | 12/1996 |
| EP | 0637094 | | 1/1997 |
| EP | 0 759 646 | A1 | 2/1997 |
| EP | 0 766 341 | | 2/1997 |
| EP | 0 766 340 | | 4/1997 |
| EP | 0751043 | | 4/1997 |
| EP | 0807988 | | 11/1997 |
| EP | 0 831 547 | A2 | 3/1998 |
| EP | 0851530 | | 7/1998 |
| EP | 0856907 | | 8/1998 |
| EP | 1 294 048 | | 1/1999 |
| EP | 0892459 | | 1/1999 |
| EP | 0766339 | | 2/1999 |
| EP | 0 942 488 | A2 | 9/1999 |
| EP | 1 003 240 | A2 | 5/2000 |
| EP | 1006605 | | 6/2000 |
| EP | 1006606 | | 6/2000 |
| EP | 1014487 | | 6/2000 |
| EP | 1024553 | | 8/2000 |
| EP | 1026774 | | 8/2000 |
| EP | 0999607 | | 10/2000 |
| EP | 1 052 723 | | 11/2000 |
| EP | 1052722 | | 11/2000 |
| EP | 1 063 722 | A2 | 12/2000 |
| EP | 1067627 | | 1/2001 |
| EP | 1094545 | | 4/2001 |
| EP | 1 102 348 | | 5/2001 |
| EP | 1098387 | | 5/2001 |
| EP | 1 113 524 | | 7/2001 |
| EP | 1113524 | | 7/2001 |
| EP | 1 128 466 | A2 | 8/2001 |
| EP | 1 139 490 | | 10/2001 |
| EP | 1 146 589 | | 10/2001 |
| EP | 1 162 688 | | 12/2001 |
| EP | 1162688 | | 12/2001 |
| EP | 0993070 | | 4/2002 |
| EP | 1 248 316 | | 9/2002 |
| EP | 0923158 | | 9/2002 |
| EP | 1 267 441 | | 12/2002 |
| EP | 1271690 | | 1/2003 |
| EP | 1 294 049 | A1 | 3/2003 |
| EP | 1306922 | | 5/2003 |
| EP | 1 329 980 | | 7/2003 |
| EP | 1 351 334 | | 8/2003 |
| EP | 1 361 623 | | 11/2003 |
| EP | 1248316 | | 1/2004 |
| EP | 1396906 | | 3/2004 |
| EP | 1 406 345 | | 4/2004 |
| EP | 1 414 108 | | 4/2004 |
| EP | 1 432 072 | | 6/2004 |
| EP | 1 437 793 | | 7/2004 |
| EP | 1439603 | | 7/2004 |
| EP | 1 445 822 | | 8/2004 |
| EP | 1 453 137 | | 9/2004 |

(56) References Cited

FOREIGN PATENT DOCUMENTS

| | | | |
|---|---|---|---|
| EP | 1 469 549 | | 10/2004 |
| EP | 1220456 | | 10/2004 |
| EP | 1467456 | | 10/2004 |
| EP | 1 482 592 | | 12/2004 |
| EP | 1 498 984 | | 1/2005 |
| EP | 1 564 839 | | 1/2005 |
| EP | 1170822 | | 4/2005 |
| EP | 1 544 943 | | 6/2005 |
| EP | 1753079 | | 2/2007 |
| EP | 1 791 213 | | 5/2007 |
| EP | 1843432 | | 10/2007 |
| FI | 20020829 | | 11/2003 |
| FI | 118782 | B1 | 3/2008 |
| FR | 2553584 | | 10/1983 |
| FR | 2724274 | | 3/1996 |
| FR | 2873247 | | 1/2006 |
| GB | 2266997 | | 11/1993 |
| GB | 2 360 422 | A | 9/2001 |
| GB | 239246 | | 12/2003 |
| JP | 1984202831 | | 11/1984 |
| JP | 600206304 | | 10/1985 |
| JP | 1986245704 | | 11/1986 |
| JP | 06152463 | | 5/1994 |
| JP | 1995131234 | | 5/1995 |
| JP | 1995221536 | | 8/1995 |
| JP | 7249923 | | 9/1995 |
| JP | 1995307612 | | 11/1995 |
| JP | 08216571 | | 8/1996 |
| JP | 09083242 | | 3/1997 |
| JP | 9260934 | | 10/1997 |
| JP | 9307344 | | 11/1997 |
| JP | 10 028013 | | 1/1998 |
| JP | 10107671 | | 4/1998 |
| JP | 10173423 | | 6/1998 |
| JP | 10 209733 | | 8/1998 |
| JP | 10224142 | | 8/1998 |
| JP | 10 327011 | | 12/1998 |
| JP | 10322124 | | 12/1998 |
| JP | 11 004117 | | 1/1999 |
| JP | 1999004113 | | 1/1999 |
| JP | 11 068456 | | 3/1999 |
| JP | 11127010 | | 5/1999 |
| JP | 11136025 | | 5/1999 |
| JP | 199127014 | | 5/1999 |
| JP | 11 355033 | | 12/1999 |
| JP | 2000278028 | | 10/2000 |
| JP | 200153543 | | 2/2001 |
| JP | 2001267833 | | 9/2001 |
| JP | 2001217631 | | 10/2001 |
| JP | 2001326513 | | 11/2001 |
| JP | 2002319811 | A | 10/2002 |
| JP | 2002329541 | | 11/2002 |
| JP | 2002335117 | | 11/2002 |
| JP | 200360417 | | 2/2003 |
| JP | 2003124730 | | 4/2003 |
| JP | 2003179426 | | 6/2003 |
| JP | 2003318638 | | 11/2003 |
| JP | 2004112028 | | 4/2004 |
| JP | 2004363859 | | 12/2004 |
| JP | 2005005985 | | 1/2005 |
| JP | 2005252661 | | 9/2005 |
| KR | 20010080521 | | 10/2001 |
| KR | 10-2006-7027462 | | 12/2002 |
| KR | 20020096016 | | 12/2002 |
| SE | 511900 | | 12/1999 |
| WO | WO 92/00635 | | 1/1992 |
| WO | WO 96/27219 | | 9/1996 |
| WO | WO 98/00191 | | 1/1998 |
| WO | WO 98/01921 | | 1/1998 |
| WO | WO 98/37592 | | 8/1998 |
| WO | WO 99/30479 | | 6/1999 |
| WO | WO 00/36700 | | 6/2000 |
| WO | WO 01/20718 | | 3/2001 |
| WO | WO 01/24316 | | 4/2001 |
| WO | WO 01/28035 | | 4/2001 |
| WO | WO 01/29927 | | 4/2001 |
| WO | WO 01/33665 | | 5/2001 |
| WO | WO 01/61781 | | 8/2001 |
| WO | WO 01/91236 | | 11/2001 |
| WO | WO 02/08672 | | 1/2002 |
| WO | WO 02/11236 | A1 | 2/2002 |
| WO | WO 02/13307 | | 2/2002 |
| WO | WO 02/41443 | | 5/2002 |
| WO | WO 02/067375 | | 8/2002 |
| WO | WO 02/078123 | | 10/2002 |
| WO | WO 02/078124 | | 10/2002 |
| WO | WO 03/094290 | | 11/2003 |
| WO | WO 2004/017462 | | 2/2004 |
| WO | WO 2004/036778 | | 4/2004 |
| WO | WO 2004/057697 | | 7/2004 |
| WO | WO 2004/070872 | | 8/2004 |
| WO | WO 2004/100313 | | 11/2004 |
| WO | WO 2004/112189 | A | 12/2004 |
| WO | WO 2005/011055 | | 2/2005 |
| WO | WO 2005/018045 | | 2/2005 |
| WO | WO 2005/034286 | | 4/2005 |
| WO | WO 2005/038981 | A1 | 4/2005 |
| WO | WO 2005/055364 | | 6/2005 |
| WO | WO 2005/062416 | | 7/2005 |
| WO | WO 2006/000631 | A1 | 1/2006 |
| WO | WO 2006/000650 | | 1/2006 |
| WO | WO 2006/051160 | A1 | 5/2006 |
| WO | WO 2006/084951 | A1 | 8/2006 |
| WO | WO 2006/097567 | | 9/2006 |
| WO | WO 2007/000483 | | 1/2007 |
| WO | WO 2007/000483 | A1 | 1/2007 |
| WO | WO 2007/012697 | | 2/2007 |
| WO | WO 2007/039667 | | 4/2007 |
| WO | WO 2007/039668 | | 4/2007 |
| WO | WO 2007/042614 | | 4/2007 |
| WO | WO 2007/042615 | | 4/2007 |
| WO | WO 2007/050600 | | 5/2007 |
| WO | WO 2007/080214 | | 7/2007 |
| WO | WO 2007/098810 | | 9/2007 |
| WO | WO 2007/138157 | | 12/2007 |
| WO | WO 2008/059106 | | 3/2008 |
| WO | WO 2008/129125 | | 10/2008 |
| WO | WO 2009/027579 | | 5/2009 |
| WO | WO 2009/095531 | | 8/2009 |
| WO | WO 2009/106682 | | 9/2009 |
| WO | WO 2010/122220 | | 10/2010 |

OTHER PUBLICATIONS

"An Adaptive Microstrip Patch Antenna for Use in Portable Transceivers", Rostbakken et al., Vehicular Technology Conference, 1996, Mobile Technology for The Human Race, pp. 339-343.

"Dual Band Antenna for Hand Held Portable Telephones", Liu et al., Electronics Letters, vol. 32, No. 7, 1996, pp. 609-610.

"Improved Bandwidth of Microstrip Antennas using Parasitic Elements," IEE Proc. vol. 127, Pt. H. No. 4, Aug. 1980.

"A 13.56MHz RFID Device and Software for Mobile Systems", by H. Ryoson, et al., Micro Systems Network Co., 2004 IEEE, pp. 241-244.

"A Novel Approach of a Planar Multi-Band Hybrid Series Feed Network for Use in Antenna Systems Operating at Millimeter Wave Frequencies," by M.W. Elsallal and B.L. Hauck, Rockwell Collins, Inc., 2003 pp. 15-24, waelsall@rockwellcollins.com_and_blhauck@rockwellcollins.com.

Abedin, M. F. and M. Ali, "Modifying the ground plane and its erect on planar inverted-F antennas (PIFAs) for mobile handsets," *IEEE Antennas and Wireless Propagation Letters*, vol. 2, 226-229, 2003.

C. R. Rowell and R. D. Murch, "A compact PIFA suitable for dual frequency 900/1800-MHz operation," *IEEE Trans. Antennas Propag.*, vol. 46, No. 4, pp. 596-598, Apr. 1998.

Cheng- Nan Hu, Willey Chen, and Book Tai, "A Compact Multi-Band Antenna Design for Mobile Handsets", *APMC 2005 Proceedings*.

Endo, T., Y. Sunahara, S. Satoh and T. Katagi, "Resonant Frequency and Radiation Efficiency of Meander Line Antennas," Electronics and Commu-nications in Japan, Part 2, vol. 83, No. 1, 52-58, 2000.

(56) References Cited

OTHER PUBLICATIONS

European Office Action, May 30, 2005 issued during prosecution of EP 04 396 001.2-1248.
Examination Report dated May 3, 2006 issued by the EPO for European Patent Application No. 04 396 079.8.
F.R. Hsiao, et al. "A dual-band planar inverted-F patch antenna with a branch-line slit," *Microwave Opt. Technol. Lett.*, vol. 32, Feb. 20, 2002.
Griffin, Donald W. et al., "Electromagnetic Design Aspects of Packages for Monolithic Microwave Integrated Circuit-Based Arrays with Integrated Antenna Elements", IEEE Transactions on Antennas and Propagation, vol. 43, No. 9, pp. 927-931, Sep. 1995.
Guo, Y. X. and H. S. Tan, "New compact six-band internal antenna," *IEEE Antennas and Wireless Propagation Letters*, vol. 3, 295-297, 2004.
Guo, Y. X. and Y.W. Chia and Z. N. Chen, "Miniature built-in quadband antennas for mobile handsets", *IEEE Antennas Wireless Propag. Lett.*, vol. 2, pp. 30-32, 2004.
Hoon Park, et al. "Design of an Internal antenna with wide and multiband characteristics for a mobile handset", *IEEE Microw. & Opt. Tech. Lett.* vol. 48, No. 5, May 2006.
Hoon Park, et al. "Design of Planar Inverted-F Antenna With Very Wide Impedance Bandwidth", *IEEE Microw. & Wireless Comp., Left.*, vol. 16, No. 3, pp. 113-115-, Mar. 2006.
Hasse, R., A. Byndas, and M. E. Bialkowski, "Improvement of compact terminal antenna performance by incorporating open-end slots in ground plane," *IEEE Microwave and Wireless Components Letters*, vol. 14, 283-285, 2004.
I. Ang, Y. X. Guo, and Y. W. Chia, "Compact internal quad-band antenna for mobile phones" *Micro. Opt. Technol. Lett.*, vol. 38, No. 3 pp. 217-223 Aug. 2003.
International Preliminary Report on Patentability for International Application No. PCT/FI2004/000554, date of issuance of report May 1, 2006.
Jing, X., et al.; "Compact Planar Monopole Antenna for Multi-Band Mobile Phones"; Microwave Conference Proceedings, 4.-7.12.2005. APMC 2005, Asia-Pacific Conference Proceedings, vol. 4.
Kim, B. C., J. H. Yun, and H. D. Choi, "Small wideband PIFA for mobile phones at 1800 MHz," *IEEE International Conference on Vehicular Technology*, 27{29, Daejeon, South Korea, May 2004.
Kim, Kihong et al., "Integrated Dipole Antennas on Silicon Substrates for Intra-Chip Communication", IEEE, pp. 1582-1585, 1999.
Kivekas., O., J. Ollikainen, T. Lehtiniemi, and P. Vainikainen, "Bandwidth, SAR, and eciency of internal mobile phone antennas," *IEEE Transactions on Electromagnetic Compatibility*, vol. 46, 71{86, 2004.
K-L Wong, *Planar Antennas for Wireless Communications*., Hoboken, NJ: Willey, 2003, ch. 2.
Lindberg., P. and E. Ojefors, "A bandwidth enhancement technique for mobile handset antennas using wavetraps," *IEEE Transactions on Antennas and Propagation*, vol. 54, 2226{2232, 2006.
Marta Martinez-Vazquez, et al., "Integrated Planar Multiband Antennas for Personal Communication Handsets", *IEEE Trasactions on Antennas and propagation*, vol. 54, No. 2, Feb. 2006.
P. Ciais, et al., "Compact Internal Multiband Antennas for Mobile and WLAN Standards", *Electronic Letters*, vol, 40, No. 15, pp. 920-921, Jul. 2004.
P. Ciais, R. Staraj, G. Kossiavas, and C. Luxey, "Design of an internal quadband antenna for mobile phones", *IEEE Microwave Wireless Comp. Lett.*, vol. 14, No. 4, pp. 148-150, Apr. 2004.
P. Salonen, et al. "New slot configurations for dual-band planar inverted-F antenna," *Microwave Opt. Technol.*, vol. 28, pp. 293-298, 2001.
Papapolymerou, Ioannis et al., "Micromachined Patch Antennas", IEEE Transactions on Antennas and Propagation, vol. 46, No. 2, pp. 275-283, Feb. 1998.
Product of the Month, RFDesign, "GSM/GPRS Quad Band Power Amp Includes Antenna Switch," 1 page, reprinted Nov. 2004 issue of RF Design (www.rfdesign.com), Copyright 2004, Freescale Semiconductor, RFD-24-EK.
S. Tarvas, et al. "An internal dual-band mobile phone antenna," in *2000 IEEE Antennas Propagat. Soc. Int. Symp. Dig.*, pp. 266-269, Salt Lake City, UT, USA.
Wang, F., Z. Du, Q. Wang, and K. Gong, "Enhanced-bandwidth PIFA with T-shaped ground plane," *Electronics Letters*, vol. 40, 1504-1505, 2004.
Wang, H.; "Dual-Resonance Monopole Antenna with Tuning Stubs"; IEEE Proceedings, Microwaves, Antennas & Propagation, vol. 153, No. 4, Aug. 2006; pp. 395-399.
Wong, K., et al.; "A Low-Profile Planar Monopole Antenna for Multiband Operation of Mobile Handsets"; IEEE Transactions on Antennas and Propagation, Jan. '03, vol. 51, No. 1.
X.-D. Cal and J.-Y. Li, Analysis of asymmetric TEM cell and its optimum design of electric field distribution, IEE Proc 136 (1989), 191-194.
X.-Q. Yang and K.-M. Huang, Study on the key problems of interaction between microwave and chemical reaction, Chin Jof Radio Sci 21 (2006), 802-809.
Chiu, C.-W., et al., "A Meandered Loop Antenna for LTE/WWAN Operations in a Smartphone," Progress In Electromagnetics Research C, vol. 16, pp. 147-160, 2010.
Lin, Sheng-Yu; Liu, Hsien-Wen; Weng, Chung-Hsun; and Yang, Chang-Fa, "A miniature Coupled loop Antenna to be Embedded in a Mobile Phone for Penta-band Applications," Progress in Electromagnetics Research Symposium Proceedings, Xi'an, China, Mar. 22-26, 2010, pp. 721-724.
Zhang, Y.Q., et al. "Band-Notched UWB Crossed Semi-Ring Monopole Antenna," Progress in Electronics Research C, vol. 19, 107-118, 2011, pp. 107-118.
Singh, Rajender, "Broadband Planar Monopole Antennas," M.Tech credit seminar report, Electronic Systems group, EE Dept, IIT Bombay, Nov. 2003, pp. 1-24.
Gobien, Andrew, T. "*Investigation of Low Profile Antenna Designs for Use in Hand-Held Radios*,"Ch.3, *The Inverted-L Antenna and Variations*; Aug. 1997, pp. 42-76.
See, C.H., et al., "Design of Planar Metal-Plate Monopole Antenna for Third Generation Mobile Handsets," Telecommunications Research Centre, Bradford University, 2005, pp. 27-30.
"LTE—An introduction," Ericsson White Paper, Jun. 2009, pp. 1-16.
"Spectrum Analysis for Future LTE Deployments," Motorola White Paper, 2007, pp. 1-8.
Chi, Yun-Wen, et al. "Quarter-Wavelength Printed Loop Antenna With an Internal Printed Matching Circuit for GSM/DCS/PCS/UMTS Operation in the Mobile Phone," IEEE Transactions on Antennas and Propagation, vol. 57, No. 9m Sep. 2009, pp. 2541-2547.
Wong, Kin-Lu, et al. "Planar Antennas for WLAN Applications," Dept. of Electrical Engineering, National Sun Yat-Sen University, 2002 09 Ansoft Workshop, pp. 1-45.
"λ/4 printed monopole antenna for 2.45GHz," Nordic Semiconductor, White Paper, 2005, pp. 1-6.
White, Carson, R., "Single- and Dual-Polarized Slot and Patch Antennas with Wide Tuning Ranges," The University of Michigan, 2008.
Extended European Search Report dated Jan. 30, 2013, issued by the EPO for European Patent Application No. 12177740.3.

* cited by examiner

CHASSIS-EXCITED ANTENNA APPARATUS AND METHODS

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

1. Field of the Invention

The present invention relates generally to antenna apparatus for use in electronic devices such as wireless or portable radio devices, and more particularly in one exemplary aspect to a chassis-excited antenna, and methods of tuning and utilizing the same.

2. Description of Related Technology

Internal antennas are commonly found in most modern radio devices, such as mobile computers, mobile phones, Blackberry® devices, smartphones, personal digital assistants (PDAs), or other personal communication devices (PCD). Typically, these antennas comprise a planar radiating plane and a ground plane parallel thereto, which are connected to each other by a short-circuit conductor in order to achieve the matching of the antenna. The structure is configured so that it functions as a resonator at the desired operating frequency. It is also a common requirement that the antenna operate in more than one frequency band (such as dual-band, tri-band, or quad-band mobile phones), in which case two or more resonators are used. Typically, these internal antennas are located on a printed circuit board (PCB) of the radio device, inside a plastic enclosure that permits propagation of radio frequency waves to and from the antenna(s).

Recent advances in the development of affordable and power-efficient display technologies for mobile applications (such as liquid crystal displays (LCD), light-emitting diodes (LED) displays, organic light emitting diodes (OLED), thin film transistors (TFT), etc.) have resulted in a proliferation of mobile devices featuring large displays, with screen sizes of up to 180 mm (7 in) in some tablet computers and up to 500 mm (20 inches) in some laptop computers.

Furthermore, current trends increase demands for thinner mobile communications devices with large displays that are often used for user input (touch screen). This in turn requires a rigid structure to support the display assembly, particularly during the touch-screen operation, so as to make the interface robust and durable, and mitigate movement or deflection of the display. A metal body or a metal frame is often utilized in order to provide a better support for the display in the mobile communication device.

The use of metal enclosures/chassis and smaller thickness of the device enclosure create new challenges for radio frequency (RF) antenna implementations. Typical antenna solutions (such as monopole, PIFA antennas) require ground clearance area and sufficient height from ground plane in order to operate efficiently in multiple frequency bands. These antenna solutions are often inadequate for the aforementioned thin devices with metal housings and/or chassis, as the vertical distance required to separate the radiator from the ground plane is no longer available. Additionally, the metal body of the mobile device acts as an RF shield and degrades antenna performance, particularly when the antenna is required to operate in several frequency bands Various methods are presently employed to attempt to improve antenna operation in thin communication devices that utilize metal housings and/or chassis, such as a slot antenna described in EP1858112B1. This implementation requires fabrication of a slot within the printed wired board (PWB) in proximity to the feed point, as well as along the entire height of the device. For a device having a larger display, slot location, that is required for an optimal antenna operation, often interferes with device user interface functionality (e.g. buttons, scroll wheel, etc), therefore limiting device layout implementation flexibility Additionally, metal housing must have openings in close proximity to the slot on both sides of the PCB. To prevent generation of cavity modes within the device, the openings are typically connected using metal walls. All of these steps increase device complexity and cost, and impede antenna matching to the desired frequency bands.

Accordingly, there is a salient need for a wireless antenna solution for e.g., a portable radio device with a small form factor metal body and/or chassis that offers a lower cost and complexity and provides for improved control of antenna resonance, and methods of tuning and utilizing the same.

SUMMARY OF THE INVENTION

The present invention satisfies the foregoing needs by providing, inter alia, a space-efficient multiband antenna apparatus and methods of tuning and use.

In a first aspect of the invention, an antenna component for use in a portable communications device is disclosed. In one embodiment, the antenna component comprises: a radiator having a first dimension and a second dimension, a first and second surface, the radiator configured to be proximate to a first side of said plurality of sides; a dielectric substrate having a third dimension and a fourth dimension, and configured to be disposed proximate the second surface; and a feed conductor configured to couple to the radiator element at a feed point.

In one variant, the dielectric substrate is configured such that its normal projection is equal or larger than a normal projection of the radiator element. The radiator element is further electrically coupled to the ground at a ground point. At least a portion of the feed conductor is further arranged along the first side substantially parallel to the first dimension; and the radiator element, the at least a portion of the feed conductor, and at least a portion of the first side form a coupled loop antenna operable in a first frequency band.

In another variant, the antenna component further comprises a dielectric element disposed between the radiator element and the first side and configured to electrically isolate at least a portion of the first side from the radiator element; e.g., a dielectric substrate and a conductive coating disposed thereon, or a flex circuit.

In another variant, the radiator element of the antenna component comprises a conductive structure having a first portion and a second portion. The second portion is coupled to the feed point via a reactive circuit. The antenna component further comprises a dielectric element disposed between the radiator element and the first side and configured to electrically isolate at least a portion of the first side from the radiator element. The reactive circuit of the antenna component comprises e.g., a planar transmission line.

In yet another variant, the radiator element comprises a dielectric substrate, and a conductive coating disposed thereon; and the conductive structure comprises the conductive coating.

In another embodiment, the antenna component comprises: a dielectric substrate having a plurality of surfaces; a conductive coating disposed on at least one surface of the substrate, the conductive coating configured to form at least a portion of a ground plane, the ground plane having a ground point; and a radiator structure. In one variant, the radiator structure comprises: a feed; a first portion, a second portion, a stripline coupled from said second portion to said feed point; and a plurality of non conductive slots isolating substantially separating the strip line from the first portion; and at least one ground clearance area disposed substantially within perimeter of the surface. The ground point is further configured to couple the at least a portion of the ground plane to a ground of a host device. The second portion is coupled to the first portion via a conductive element.

In another variant, the second portion of the antenna component is further coupled to the first portion via a reactive circuit. The reactive circuit comprises e.g., at least one of (i) an inductive element, and/or (ii) a capacitive element.

In a second aspect of the invention, an antenna apparatus for use in a portable communications device is disclosed. In one embodiment, the antenna apparatus comprises: a first antenna assembly configured to operate in a first frequency band, and a second antenna assembly configured to operate in a second frequency band. The first antenna assembly comprises a first radiator element comprising a first ground point and a first feed point, and is disposed along a first of the plurality of sides of the device enclosure, a first feed conductor coupled to the first feed point and to the at least one feed port of the device, and a first non-conductive cover disposed proximate the first radiator so as to substantially cover the first radiator. The second antenna assembly comprises a second radiator element comprising a second ground point and a second feed point, and is disposed along a second of the plurality of sides the device enclosure; a second feed conductor coupled to the second feed point and to a feed port of the device, and a second non-conductive cover disposed proximate the second radiator so as to substantially cover the second radiator.

In one variant, the metal enclosure of the device is electrically coupled to device ground, to the first ground point, and to the second ground point. At least a portion of the first feed cable is disposed along the first side thereby forming a first coupled loop antenna structure between at least a portion of the enclosure, the first radiator element, and the at least a portion of the first feed cable. At least a portion of the second feed cable is disposed along the second side thereby forming a second coupled loop antenna structure between at least a portion of the enclosure, the second radiator element, and the at least a portion of the second feed cable.

In another variant, the first and second radiator elements are disposed substantially between the first and second covers, respectively, and the metal enclosure.

In yet another variant, the antenna apparatus further comprises a dielectric element disposed between the radiator element and the first side and configured to electrically isolate at least a portion of the first side from the radiator element.

In another variant the first and the second radiator elements of the antenna are disposed substantially between the first and second covers, respectively, and the metal enclosure.

hi yet another variant, the first and the second antenna elements are disposed on opposing surfaces of the device enclosure. In another variant, the first and the second antenna elements are disposed on adjacent sizes of the device enclosure.

In another embodiment of the antenna apparatus, the first frequency band of the antenna comprises a frequency band between 700 and 960 MHz, and the second frequency band comprised an upper frequency band.

In one variant, the upper frequency band comprises frequency band between 1710 and 2150 MHz. In another variant, the upper frequency band comprises a global positioning system (GPS) frequency band.

In another variant, the portable device comprises a single feed port.

In yet another variant, the device enclosure is fabricated to form a sleeve like shape having a first cavity and a second cavity. A first metal support structure is disposed within the first cavity and configured to receive the first radiator element. A second metal support structure is disposed within the second cavity and configured to receive the second radiator element.

In a third aspect of the invention, a mobile communications device is disclosed. In one embodiment, the mobile communications device comprises: a substantially metallic exterior housing comprising a plurality of sides; an electronics assembly contained substantially therein and comprising a ground and at least one feed port; and a first antenna assembly configured to operate in a first frequency band. In one variant, the first assembly comprises: (1) a first radiator element comprising a first ground point and a first feed point, and disposed along a first of the plurality of sides; a first feed conductor coupled to the first feed point and to the at least one feed port; and a first non-conductive cover disposed proximate the first radiator so as to substantially cover the first radiator; and (ii) a second antenna assembly configured to operate in a second frequency band, the second assembly comprising: a second radiator element comprising a second ground point and a second feed point, disposed along a second of the plurality of sides; a second feed conductor coupled to the second feed point and to a feed port; and a second non-conductive cover disposed proximate the second radiator so as to substantially cover the second radiator. The first ground point and the second ground point are electrically coupled to the metal housing. A first coupled loop resonance structure is formed between at least a portion of the housing, the first radiator, and at least a portion of the first feed cable. A second coupled loop resonance structure is formed between at least a portion of the housing, the second radiator, and at least a portion of the second feed cable.

In a fourth aspect of the invention, a method of operating an antenna apparatus is disclosed.

In a fifth aspect of the invention, a method of tuning an antenna apparatus is disclosed.

In a sixth aspect of the invention, a method of testing an antenna apparatus is disclosed.

In a seventh aspect of the invention, a method of operating a mobile device is disclosed.

Further features of the present invention, its nature and various advantages will be more apparent from the accompanying drawings and the following detailed description.

BRIEF DESCRIPTION OF THE DRAWINGS

The features, objectives, and advantages of the invention will become more apparent from the detailed description set forth below when taken in conjunction with the drawings, wherein.

Figure 1:
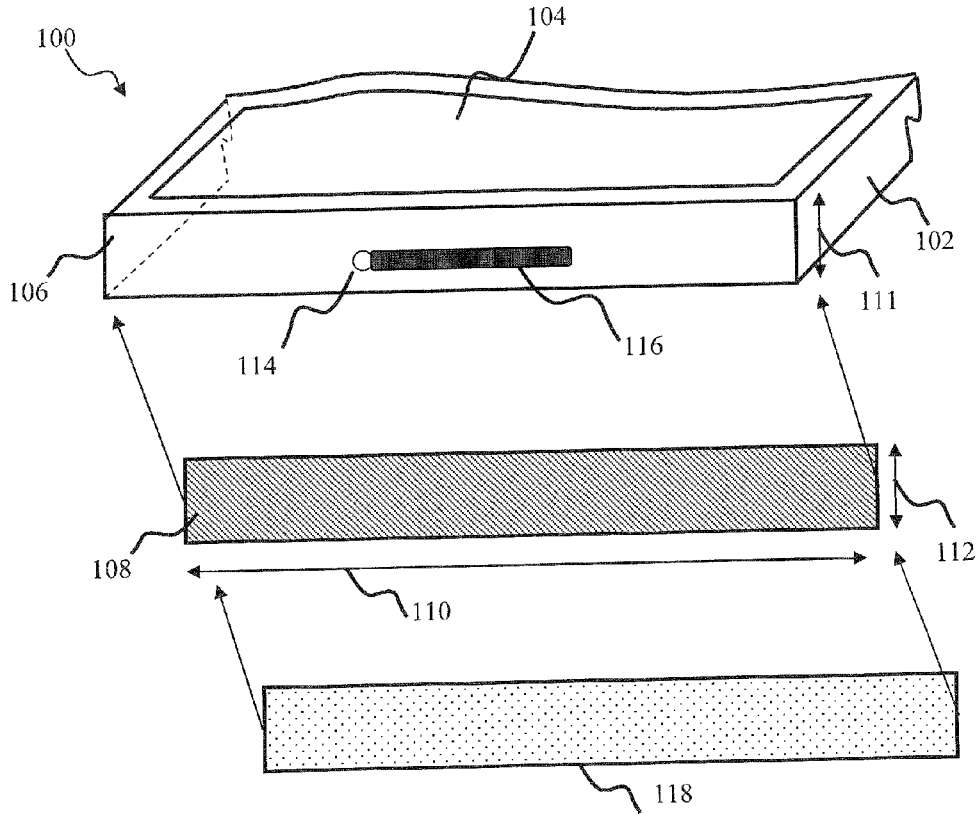
FIG. 1 is a perspective view diagram detailing the configuration of a first embodiment of an antenna assembly of the invention.

All Figures disclosed herein are © Copyright 2011 Pulse Finland Oy. All rights reserved.

DETAILED DESCRIPTION OF THE PREFERRED EMBODIMENT

Reference is now made to the drawings wherein like numerals refer to like parts throughout.

As used herein, the terms "antenna," "antenna system," "antenna assembly", and "multi-band antenna" refer without limitation to any system that incorporates a single element, multiple elements, or one or more arrays of elements that receive/transmit and/or propagate one or more frequency bands of electromagnetic radiation. The radiation may be of numerous types, e.g., microwave, millimeter wave, radio frequency, digital modulated, analog, analog/digital encoded, digitally encoded millimeter wave energy, or the like. The energy may be transmitted from location to another location, using, or more repeater links, and one or more locations may be mobile, stationary, or fixed to a location on earth such as a base station.

As used herein, the terms "board" and "substrate" refer generally and without limitation to any substantially planar or curved surface or component upon which other components can be disposed. For example, a substrate may comprise a single or multi-layered printed circuit board (e.g., FR4), a semi-conductive die or wafer, or even a surface of a housing or other device component, and may be substantially rigid or alternatively at least somewhat flexible.

The terms "frequency range", "frequency band", and "frequency domain" refer without limitation to any frequency range for communicating signals. Such signals may be communicated pursuant to one or more standards or wireless air interfaces.

The terms "near field communication", "NFC", and "proximity communications", refer without limitation to a short-range high frequency wireless communication technology which enables the exchange of data between devices over short distances such as described by ISO/IEC 18092/ECMA-340 standard and/or ISO/ELEC 14443 proximity-card standard.

As used herein, the terms "portable device", "mobile computing device", "client device", "portable computing device", and "end user device" include, but are not limited to, personal computers (PCs) and minicomputers, whether desktop, laptop, or otherwise, set-top boxes, personal digital assistants (PDAs), handheld computers, personal communicators, tablet computers, portable navigation aids, J2ME equipped devices, cellular telephones, smartphones, personal integrated communication or entertainment devices, or literally any other device capable of interchanging data with a network or another device.

Furthermore, as used herein, the terms "radiator," "radiating plane," and "radiating element" refer without limitation to an element that can function as part of a system that receives and/or transmits radio-frequency electromagnetic radiation; e.g., an antenna.

The terms "RF feed," "feed," "feed conductor," and "feed network" refer without limitation to any energy conductor and coupling element(s) that can transfer energy, transform impedance, enhance performance characteristics, and conform impedance properties between an incoming/outgoing RF energy signals to that of one or more connective elements, such as for example a radiator.

As used herein, the terms "top", "bottom", "side", "up", "down", "left", "right", and the like merely connote a relative position or geometry of one component to another, and in no way connote an absolute frame of reference or any required orientation. For example, a "top" portion of a component may actually reside below a "bottom" portion when the component is mounted to another device (e.g., to the underside of a PCB).

As used herein, the term "wireless" means any wireless signal, data, communication, or other interface including without limitation Wi-Fi, Bluetooth, 3G (e.g., 3GPP, 3GPP2, and UMTS), HSDPA/HSUPA, TDMA, CDMA (e.g., IS-95A, WCDMA, etc.), FHSS, DSSS, GSM, PAN/802.15, WiMAX (802.16), 802.20, narrowband/FDMA, OFDM, PCS/DCS, Long Term Evolution (LTE) or LTE-Advanced (LTE-A), analog cellular, CDPD, satellite systems such as GPS, millimeter wave or microwave systems, optical, acoustic, and infrared (i.e., IrDA).

Overview

The present invention provides, in one salient aspect, an antenna apparatus for use in a mobile radio device which advantageously provides reduced size and cost, and improved antenna performance. In one embodiment, the mobile radio device includes two separate antenna assemblies located on the opposing sides of the device: i.e., (i) on the top and bottom sides; or (ii) on the left and right sides. In another embodiment, two antenna assemblies are placed on the adjacent sides, e.g., one element on a top or bottom side, and the other on a left or the right side.

Each antenna assembly of the exemplary embodiment includes a radiator element that is coupled to the metal portion of the mobile device housing (e.g., side surface). The radiator element is mounted for example directly on the metal enclosure side, or alternatively on an intermediate metal carrier (antenna support element), that is in turn fitted within the mobile device metal enclosure. To reduce potentially adverse influences during use under diverse operating conditions, e.g., hand usage scenario, a dielectric cover is fitted against the radiator top surface, thereby insulating the antenna from the outside elements.

In one embodiment, a single multi-feed transceiver is configured to provide feed to both antenna assemblies. Each antenna may utilize a separate feed; each antenna radiator element directly is coupled to a separate feed port of the mobile radio device electronics via a separate feed conductor. This, inter alit; enables operation of each antenna element in a separate frequency band (e.g., a lower band and an upper band). Advantageously, antenna coupling to the device electronics is much simplified, as each antenna element requires only a single feed and a single ground point connections. The phone chassis acts as a common ground plane for both antennas.

In one implementation, the feed conductor comprises a coaxial cable that is routed through an opening in the mobile device housing. A portion of the feed cable is routed along lateral dimension of the antenna radiator from the opening point to the feed point on the radiator. This section of the feed conductor, in conjunction with the antenna radiator element, forms the loop antenna, which is coupled to the metallic chassis and hence referred to as the "coupled loop antenna".

In one variant, one of the antenna assemblies is configured to provide near-field communication functionality to enables the exchange of data between the mobile device and another device or reader (e.g., during device authentication, payment transaction, etc.).

In another variant, two or more antennas configured in accordance with the principles of the present invention are configured to operate in the same frequency band, thus providing diversity for multiple antenna applications (such as e.g., Multiple In Multiple Out (MIMO), Multiple In Single Out (MISO), etc.).

In yet another variant, a single-feed antenna is configured to operate in multiple frequency bands.

Detailed Description of Exemplary Embodiments

Detailed descriptions of the various embodiments and variants of the apparatus and methods of the invention are now provided. While primarily discussed in the context of mobile devices, the various apparatus and methodologies discussed herein are not so limited. In fact, many of the apparatus and methodologies described herein are useful in any number of complex antennas, whether associated with mobile or fixed devices that can benefit from the coupled loop chassis excited antenna methodologies and apparatus described herein.

Exemplary Antenna Apparatus

Figure 2A:
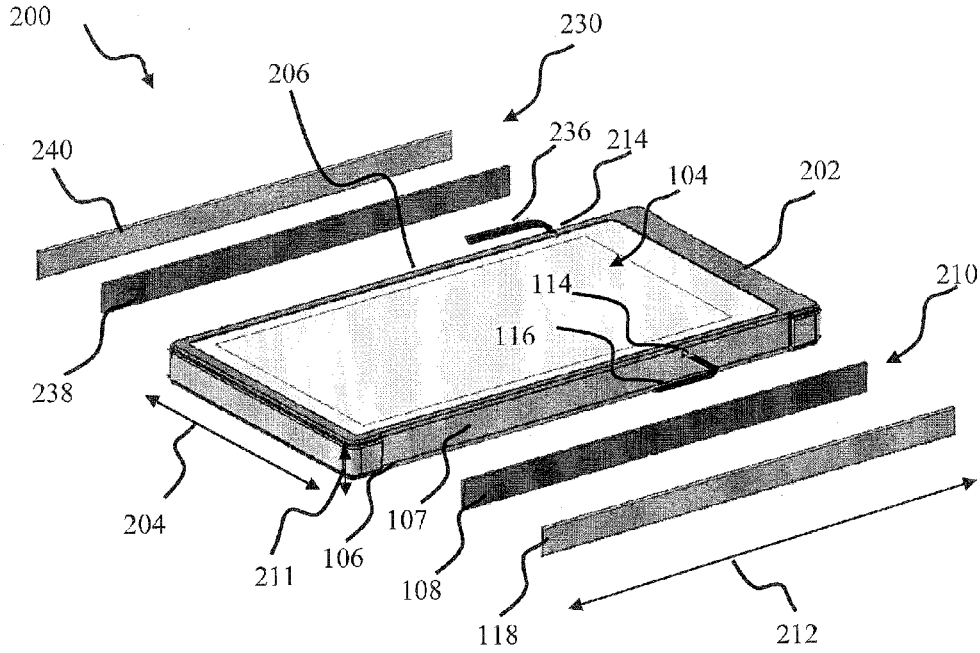
FIG. 2A is an isometric view of a mobile communications device configured in accordance with a first embodiment of the present invention.
Figure 2B:
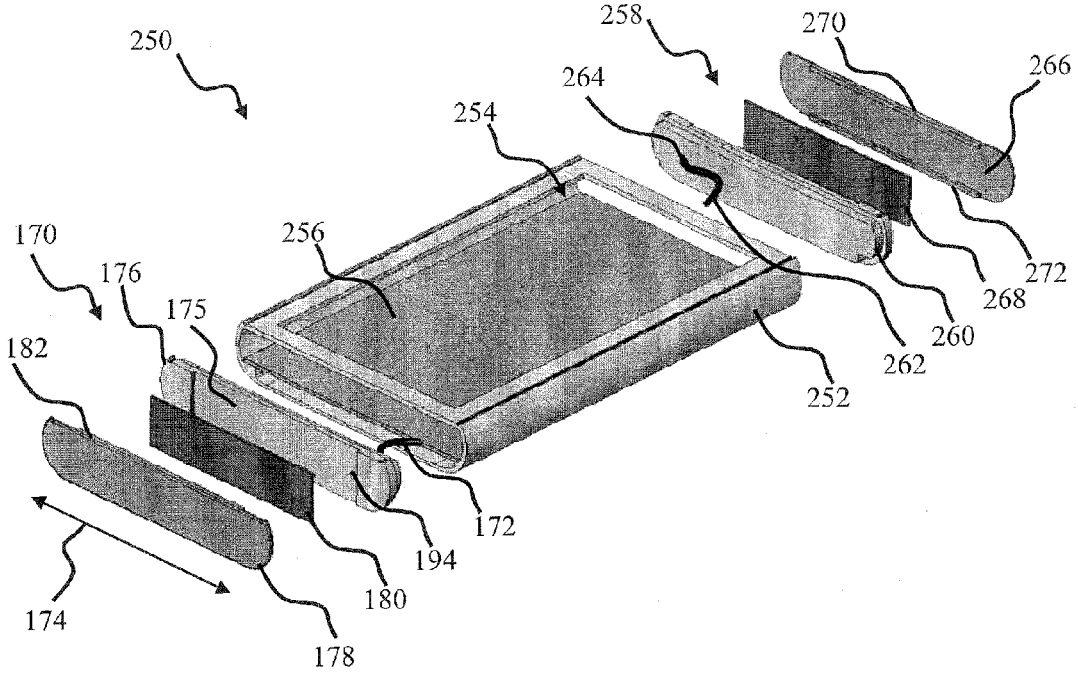
FIG. 2B is an isometric view of a mobile communications device configured in accordance with a second embodiment of the present invention.
Figure 2C:
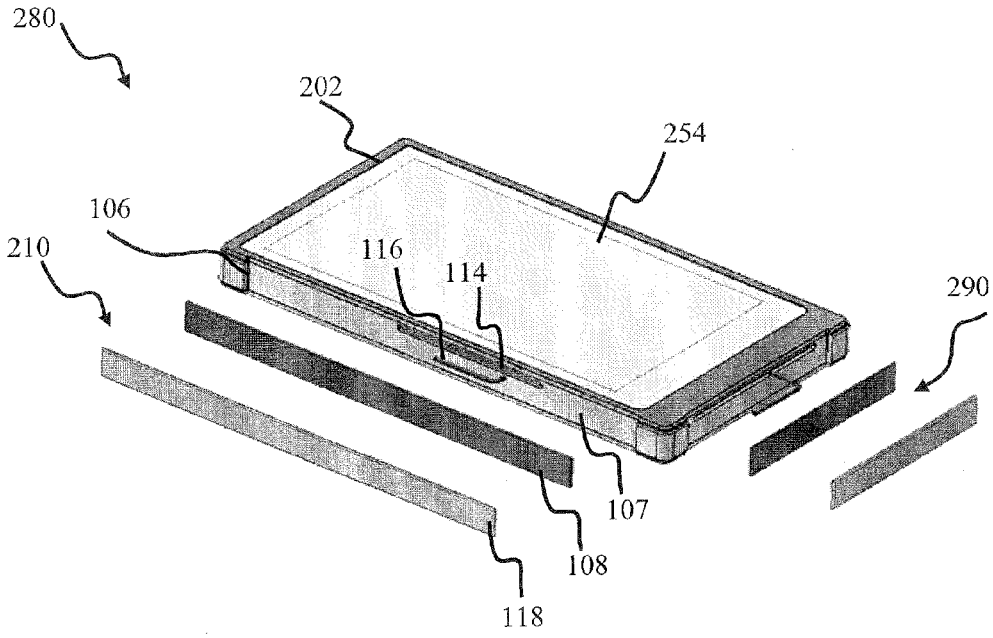
FIG. 2C is an isometric view of a mobile communications device configured in accordance with a third embodiment of the present invention.

Referring now to FIGS. 1 through 2C, exemplary embodiments of the radio antenna apparatus of the invention are described in detail.

It will be appreciated that while these exemplary embodiments of the antenna apparatus of the invention are implemented using a coupled loop chassis excited antenna (selected in these embodiments for their desirable attributes and performance), the invention is in no way limited to the loop antenna configurations, and in fact can be implemented using other technologies, such as patch or microstrip antennas.

One exemplary embodiment 100 of an antenna component for use in a mobile radio device is presented in FIG. 1, showing an end portion of the mobile device housing 102. The housing 102 (also referred to as metal chassis or enclosure) is fabricated from a metal or alloy (such as aluminum alloy) and is configured to support a display element 104. In one variant, the housing 102 comprises a sleeve-type form, and is manufactured by extrusion. In another variant, the chassis 102 comprises a metal frame structure with an opening to accommodate the display 104. A variety of other manufacturing methods may be used consistent with the invention including, but not limited to, stamping, milling, and casting.

In one embodiment, the display 104 comprises a display-only device configured only to display content or data. In another embodiment, the display 104 is a touch screen display (e.g., capacitive or other technology) that allows for user input into the device via the display 104. The display 104 may comprise, for example, a liquid crystal display (LCD), light-emitting diode (LED) display, organic light emitting diode (OLED) display, or TFT-based device. It is appreciated by those skilled in the art that methodologies of the present invention are equally applicable to any future display technology, provided the display module is generally mechanically compatible with configurations such as those described in FIG. 1-FIG. 2C.

The antenna assembly of the embodiment of FIG. 1 further comprises a rectangular radiator element 108 configured to be fitted against a side surface 106 of the enclosure 102. The side 106 can be any of the top, bottom, left, right, front, or back surfaces of the mobile radio device. Typically, modern portable devices are manufactured such that their thickness 111 is much smaller than the, length or the width of the device housing. As a result, the radiator element of the illustrated embodiment is fabricated to have an elongated shape such that the length 110 is greater than the width 112, when disposed along a side surface (e.g., left, right, top, bottom).

To access the device feed port, an opening is fabricated in the device enclosure. In the embodiment shown in FIG. 1, the opening 114 extends through the side surface 106 and serves to pass through a feed conductor 116 from a feed engine that is a part of the device RE section (not shown), located on the inside of the device. Alternatively, the opening is fabricated proximate to the radiator feed point as described in detail below.

The antenna assembly of FIG. 1 further comprises a dielectric antenna cover 118 that is installed directly above the radiator element 108. The cover 118 is configured to provide electrical insulation for the radiator from the outside environment, particularly to prevent direct contact between a user hand and the radiator during device use (which is often detrimental to antenna operation). The cover 118 is fabricated from any suitable dielectric material (e.g. plastic or glass). The cover 118 is attached by a variety of suitable means: adhesive, press-fit, snap-in with support of additional retaining members as described below.

In one embodiment, the cover 118 is fabricated from a durable oxide or glass (e.g. Zirconium dioxide $ZrO_2$, (also referred to as "zirconia"), or Gorilla® Glass, manufactured by Dow Corning) and is welded (such as via a ultrasonic-welding (USW) technique) onto the device body. Other attachment methods may be used including but not limited to adhesive, snap-fit, press-fit, heat staking, etc.

In a different embodiment (not shown), the cover comprises a non-conductive film, or non-conductive paint bonded onto one or more exterior surfaces of the radiator element(s).

Figure 1A:
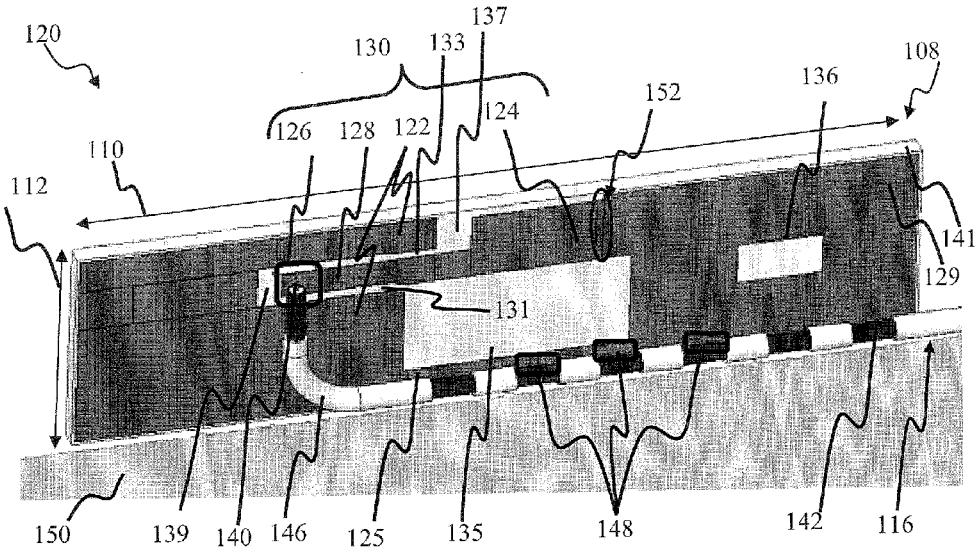
FIG. 1A is a perspective view diagram detailing the electrical configuration of the antenna radiator of the embodiment of FIG. 1.

The detailed structure of an exemplary embodiment 120 of radiator element 108 configured for mounting in a radio device is presented in FIG. 1A. The radiator element 108 comprises a conductive coating 129 disposed on a rigid substrate 141, such as a PCB fabricated from a dielectric material (e.g., FR-4). Other suitable materials, such as glass, ceramic, air are useable as well. In one variant, a conductive layer is disposed on the opposing surface of the substrate, thereby forming a portion of a ground plane. In another implementation, the radiator element is fabricated as a flex circuit (either a single-sided, or double-sided) that is mounted on a rigid support element.

The conductive coating 129 is shaped to form a radiator structure 130, which includes a first portion 122 and a second portion 124, and is coupled to the feed conductor 116 at a feed point 126. The second portion 124 is coupled to the feed point 126 via a conductive element 128, which acts as a transmission line coupling antenna radiator to chassis modes.

The first portion 122 and the second portion 124 are connected via a coupling element 125. In the exemplary embodiment of FIG. 1A, the transmission line element 128 is configured to form a finger-like projection into the first portion 122, thereby forming two narrow slots 131, 133, one on each side of the transmission line 128. The radiator 108 further includes a several ground clearance portions (135, 137, 139), which are used to form a loop structure and to tune the antenna to desired specifications (e.g., frequency, bandwidth, etc).

The feed conductor 116 of exemplary embodiment of FIG. 1A is a coaxial cable, comprising a center conductor 140, connected to the feed point 126, a shield 142, and an exterior insulator 146. In the embodiment of FIG. 1A, a portion of the feed conductor 116 is routed lengthwise along the radiator PCB 108.

The shield 148 is connected to the radiator ground plane 129 at one or more locations 148, as shown in FIG. 1A. The other end of the feed conductor 116 is connected to an appropriate feed port (not shown) of the RF section of the device electronics. In one variant this connection is effected via a radio frequency connector.

In one embodiment, a lumped reactive component 152 (e.g. inductive L or capacitive C) is coupled across the second portion 124 in order to adjust radiator electrical length. Many suitable capacitor configurations are useable in the embodiment 120, including but not limited to, a single or multiple discrete capacitors (e.g., plastic film, mica, glass, or paper), or chip capacitors. Likewise, myriad inductor configurations (e.g., air coil, straight wire conductor, or toroid core) may be used with the invention.

The radiating element 108 further comprises a ground point 136 that is configured to couple the radiating element 108 to the device ground (e.g., housing/chassis). In one variant, the radiating element 108 is affixed to the device via a conductive sponge at the ground coupling point 136 and to the feed cable via a solder joint at the feed point 126. In another variant, both above connections are effected via solder joints. In yet another variant, both connections are effected via a conductive sponge. Other electrical coupling methods are useable with embodiments of the invention including, but not limited to, c-clip, pogo pin, etc. Additionally, a suitable adhesive or mechanical retaining means (e.g., snap fit) may be used if desired to affix the radiating element to the device housing.

In one exemplary implementation, the radiator element is approximately 10 mm (0.3 in) in width and 50 mm (2 in) in length. It will be appreciated by those skilled in the art that the above antenna sizes are exemplary and are adjusted based on the actual size of the device and its operating band. In one variant, the electrical size of the antenna is adjusted by the use of a lumped reactive component 152.

Figure 1B:
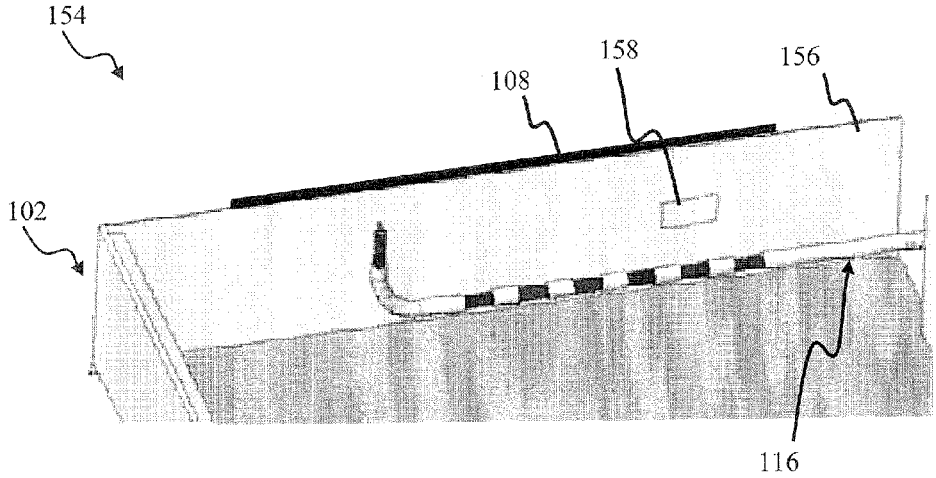
FIG. 1B is a perspective view diagram detailing the isolator structure for the antenna radiator of the embodiment of FIG. 1A.
Figure 1C:
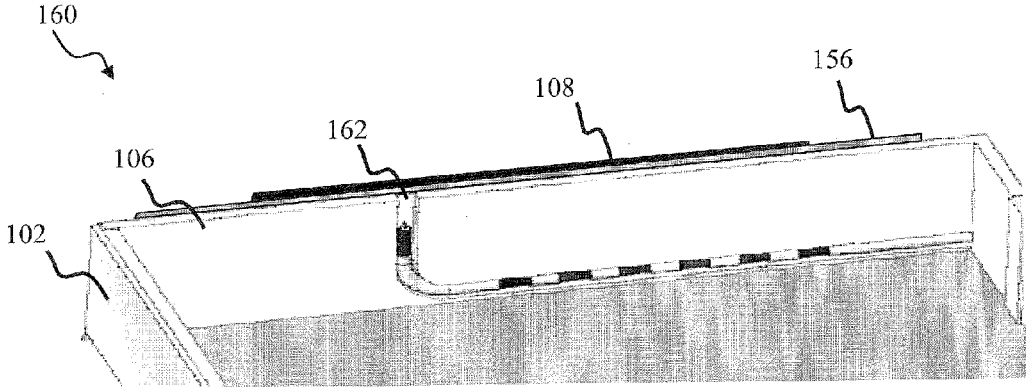
FIG. 1C is a perspective view diagram showing an interior view of a device enclosure, showing the antenna assembly of the embodiment of FIG. 1A installed therein.
Figure 1D:
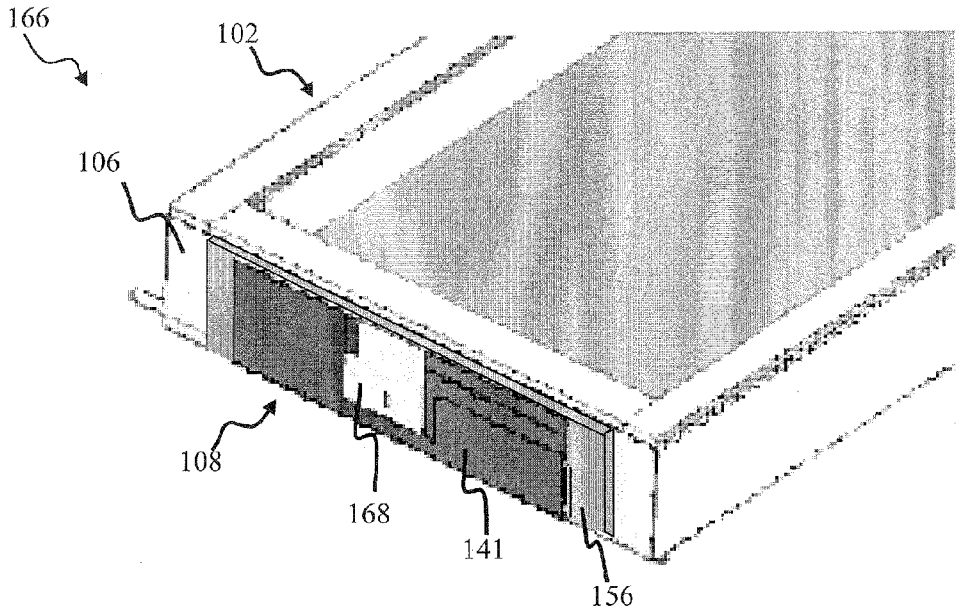
FIG. 1D is an elevation view diagram of a device enclosure showing the antenna assembly of the embodiment of FIG. 1A installed therein.

Referring now to FIGS. 1B through 1D, the details of installing one or more antenna radiating elements 108 of the embodiment of FIG. 1A into a portable device are presented. At step 154 shown in FIG. 1B, in order to ensure that radiator is coupled to ground only at the desired location (e.g. ground point 136), a dielectric screen 156 is placed against the radiating element 108 to electrically isolate the conductive structure 140 and the feed point from the device metal enclosure/chassis 102. The dielectric screen 156 comprises an opening 158 that corresponds to the location and the size of the ground point 136, and is configured to permit electrical contact between the ground point and the metal chassis. A similar opening (not shown) is fabricates at the location of the feed point. The gap created by the insulating material prevents undesirable short circuits between the radiator conductive structure 140 and the metal enclosure. In one variant, the dielectric screen comprises a plastic film or non-conducting spray, although it will be recognized by those of ordinary skill given the present disclosure that other materials may be used with equal success.

FIG. 1C shows an interior view of the radiating element 108 assembly installed into the housing 102. At step 160 the radiating element is mounted against the housing side 106, with the dielectric screen 156 fitted in-between. A channel or a groove 162 is fabricated in the side 106. The groove 162 is configured to recess the conductor flush with the outer surface of the enclosure/chassis, while permitting access to the radiator feed point. This configuration decreases the gap between the radiator element 108 and the housing side 106, thereby advantageously reducing thickness of the antenna assembly. As mentioned above, a suitable adhesive or mechanical retaining means (e.g., snap fit) may be used if desired to affix the radiating element to the device housing.

FIG. 1D shows an exterior view of the radiating element 108 assembly installed into the housing 102. At step 166 the radiating element 108 is mounted against the housing side 106, with the dielectric screen 156 fitted in between. FIG. 1D reveals the conductive coating 143 forming a portion of the ground plane of the radiating element, described above with respect to FIG. 1A. The conductive coating 143 features a ground clearance element 168 approximately corresponding to the location and the size of the ground clearance elements 135, 137 and the second portion 124 of the radiator, disposed on the opposite side of the radiator element 108.

The exemplary antenna radiator illustrated in FIG. 1A through 1D, uses the radiator structure that is configured to form a coupled loop chassis excited resonator. The feed configuration described above, wherein a portion of the feed conductor is routed along the dimension 110 of the radiator, cooperates to form the coupled loop resonator. A small gap between the loop antenna and the chassis facilitates electromagnetic coupling between the antenna radiator and the chassis. At least a portion of the metal chassis 102 forms a part of an antenna resonance structure, thereby improving antenna performance (particularly efficiency and bandwidth). In one variant, the gap is on the order of 0.1 mm, although other values may be used depending on the application.

The transmission line 128 forms a part of loop resonator and helps in coupling the chassis modes. The length of the transmission line controls coupling and feed efficiency including, e.g., how efficiently the feed energy is transferred to the housing/chassis. The optimal length of the transmission line is determined based, at least in part on, the frequency of operation: e.g., the required length of transmission line for operating band at approximately 1 GHz is twice the length of the transmission line required for the antenna operating at approximately 2 GHz band.

The use of a single point grounding configuration of the radiator to the metal enclosure/chassis (at the ground point 136) facilitates formation of a chassis excited antenna structure that is efficient, simple to manufacture, and is lower in cost compared to the existing solutions (such as conventional inverted planar inverted-F (PTA) or monopole antennas). Additionally, when using a planar configuration of the loop antenna, the thickness of the portable communication device may be reduced substantially, which often critical for satisfying consumer demand for more compact communication devices.

Returning now to FIGS. 1A-1D, the ground point of the radiator 108 is coupled directly to the metal housing (chassis) that is in turn is coupled to ground of the mobile device RF section (not shown). The location of the grounding point is determined based on the antenna design parameters such as dimension of the antenna loop element, and desired frequency band of operation. The antenna resonant frequency is further a function of the device dimension. Therefore, the electrical size of the loop antenna (and hence the location of the grounding point) depends on the placement of the loop. In one variant, the electrical size of the loop PCB is about 50 mm for the lower band radiator (and is located on the bottom side of the device enclosure), and about 30 mm for the upper band radiator (and is located on the top side of the device enclosure). It is noted that positioning of the antenna radiators along the longer sides of the housing (e.g., left side and right side) produces loop of a larger electrical size. Therefore, the dimension(s) of the loop may need to be adjusted accordingly in order to match the desired frequency band of operation The length of the feed conductor is determined by a variety of design parameters for a specific device (e.g., enclosure dimensions, operating frequency band, etc.). In the exemplary embodiment of FIG. 1A, the feed conductor 116 is approximately 50 mm (2 in) in length, and it is adjusted according to device dimension(s), location of RF electronics section (on the main PCB) and antenna dimension(s) and placement.

The antenna configuration described above with respect to FIGS. 1-1D allows construction of an antenna that results in a very small space used within the device size: in effect, a 'zero-volume' antenna. Such small volume antennas advantageously facilitate antenna placement in various locations on the device chassis, and expand the number of possible locations and orientations within the device. Additionally, the use of the chassis coupling to aid antenna excitation allows modifying the size of loop antenna element required to support a particular frequency band.

Antenna performance is improved in the illustrated embodiments (compared to the existing solutions) largely because the radiator element(s) is/are placed outside the metallic chassis, while still being coupled to the chassis.

The resonant frequency of the antenna is controlled by (i) altering the size of the loop (either by increasing/decreasing the length of the radiator, or by adding series capacitor/inductor); and/or (ii) the coupling distance between the antenna and the metallic chassis.

The placement of the antenna is chosen based on the device specification, and accordingly the size of the loop is adjusted in accordance with antenna requirements.

In the exemplary implementation illustrated in FIGS. 1A-1D the radiating structure 130 and the ground point 138 are position such that both faces the device enclosure/chassis. It is recognized by those skilled in the art that other implementations are suitable, such as one or both elements 130, 138 facing outwards towards the cover 118. When the radiator structure 130 faces outwards from the device enclosure, a matching hole is fabricated in the substrate 141 to permit access to the feed center conductor 140. In one variation, the ground point 136 is placed on the ground plane 143, instead of the ground plane 129.

Figure 1E:
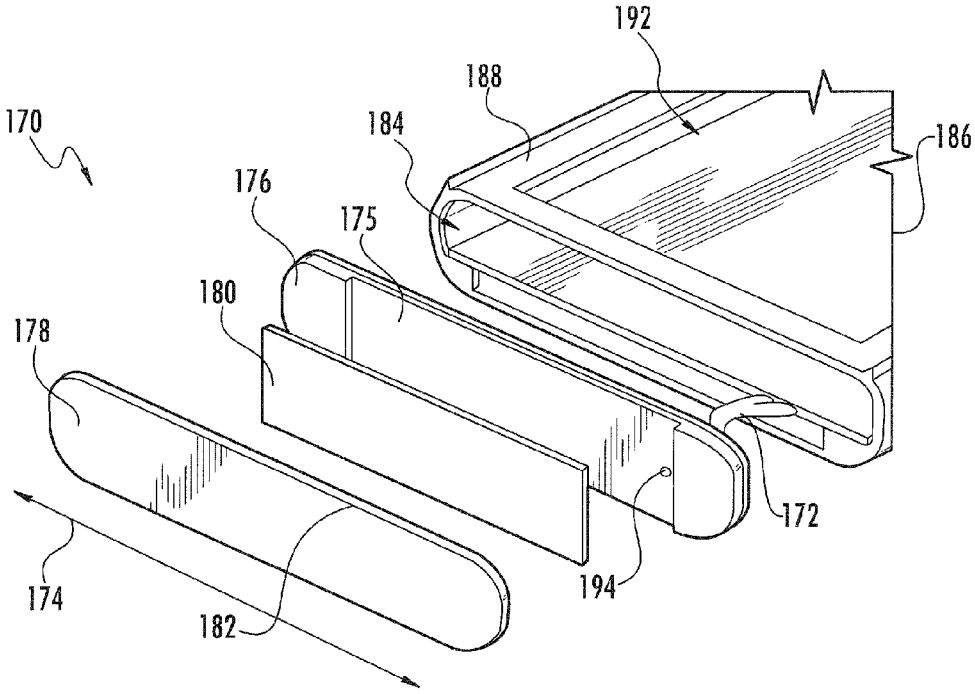
FIG. 1E is an elevation view illustration detailing the configuration of a second embodiment of the antenna assembly of the invention.

FIG. 1E shows another embodiment of the antenna assembly of the invention that is specifically configured to fit into a top or a bottom side 184 of the portable device housing 188. In this embodiment, the housing comprises a sleeve-like shape (e.g., with the top 184 and the bottom sides open). A metal support element 176 is used to mount the antenna radiator element 180.

The implementation of FIG. 1E provides a fully metallic chassis, and ensures rigidity of the device. In one variant, the enclosure and the support element are manufactured from the same material (e.g., aluminum alloy), thus simplifying manufacturing, reducing cost and allowing to achieve a seamless structure for the enclosure via decorative post processing processes.

In an alternative embodiment (e.g., as shown above in FIGS. 1C and 1D), the device housing comprises a metal enclosure with closed vertical sides (e.g., right, left, top and bottom), therefore, not requiring additional support elements, such as the support element 168 of FIG. 1D.

The device display (not shown) is configured to fit within the cavity 192 formed on the upper surface of the device housing. An antenna cover 178 is disposed above the radiator element 180 so as to provide isolation from the exterior influences.

The support element 176 is formed to fit precisely into the opening 184 of the housing and is attached to the housing via any suitable means including for example press fit, microwelding, or fasteners (e.g. screws, rivets, etc.), or even suitable adhesives. The exterior surface 175 of the support element 176 is shaped to receive the antenna radiator 180. The support element 178 further comprises an opening 194 that is designed to pass through the feed conductor 172. The feed conductor 172 is connected to the PCB 189 of the portable device and to the feed point (not shown) of the antenna radiator element 180.

In one embodiment, the feed conductor, the radiator structure, and the ground coupling arrangement are configured similarly to the embodiments described above with respect to FIGS. 1A-1B.

In one variant, a portion of the feed conductor length is routed lengthwise along the dimension 174 of the antenna support element 176: e.g., along an interior surface of the element 176, or along the exterior surface. Matching grooves may also be fabricated on the respective surface of the support element 168 to recess the feed conductor flush with the surface if desired.

In a different embodiment (not shown), a portion of the feed conductor 172 is routed along a lateral edge of the support element 178. To accommodate this implementation, the opening 194 is fabricated closer to that lateral edge.

The radiating element 180 is affixed to the chassis via a conductive sponge at the ground coupling point and to the feed cable via a solder joint at the feed point. In one variant, both couplings are effected via solder joints. Additionally or alternatively, a suitable adhesive or mechanical retaining means (e.g., snap fit, c-clip) may be used if desired.

The radiator cover 178 is, in the illustrated embodiment, fabricated from any suitable dielectric material (e.g. plastic). The radiator cover 178 is attached to the device housing by any of a variety of suitable means, such as: adhesive; press-fit, snap-in fit with support of additional retaining members 182, etc.

In a different construction (not shown), the radiator cover 178 comprises a non-conductive film, laminate, or non-conductive paint bonded onto one or more of the exterior surfaces of the respective radiator element.

In one embodiment, a thin layer of dielectric is placed between the radiating element 180, the coaxial cable 172 and the metal support 176 in order to prevent direct contact between the radiator and metal carrier in all but one location: the ground point. The insulator (not shown) has an opening that corresponds to the location and size of the ground point on the radiator element 180, similarly to the embodiment described above with respect to FIG. 1A.

The cover 178 is fabricated from a durable oxide or glass (e.g. zirconia, or Gorilla® Glass manufactured by Dow Corning) and is welded (i.e., via a ultrasonic-welding (USW) technique) onto the device body. Other attachment methods are useable including but not limited to adhesive, snap-fit, press-fit, heat staking, etc.

Similarly to the prior embodiment of FIG. 1A, the antenna radiator element 180, the feed conductor 172, the metal support 176, and the device enclosure cooperate to form a coupled loop resonator, thereby facilitating formation of the chassis excited antenna structure that is efficient, simple to manufacture and is lower cost compared to the existing solutions.

As with exemplary antenna implementation described above with respect to FIGS. 1A-1D, antenna performance for the device of FIG. 1E is improved compared to the existing implementations, largely because the radiator element is placed outside the metallic enclosure/chassis, while still being coupled to the chassis.

Exemplary Mobile Device Configuration

Referring now to FIG. 2A, an exemplary embodiment 200 of a mobile device comprising two antenna components configured in accordance with the principles of the present invention is shown and described. The mobile device comprises a metal enclosure (or chassis) 202 having a width 204, a length 212, and a thickness (height) 211. Two antenna elements 210, 230, configured similarly to the embodiment of FIG. 1A, are disposed onto two opposing sides 106, 206 of the housing 202, respectively. Each antenna element is configured to operate in a separate frequency band (e.g., one antenna 210 in a lower frequency band, and one antenna 230 in an upper frequency band, although it will be appreciated that less or more and/or different bands may be formed based on varying configurations and/or numbers of antenna elements). Other configurations may be used consistent with the present invention, and will be recognized by those of ordinary skill given the present disclosure. For example, both antennas can be configured to operate in the same frequency band, thereby providing diversity for MIMO operations. In another embodiment, one antenna assembly is configured to operate in an NFC-compliant frequency band, thereby enabling short range data exchange during, e.g., payment transactions.

The illustrated antenna assembly 210 comprises a rectangular antenna radiator 108 disposed on the side 106 of the enclosure, and coupled to the feed conductor 116 at a feed point (not shown). To facilitate mounting of the radiator 108, a pattern 107 is fabricated on the side 106 of the housing. The feed conductor 116 is fitted through an opening 114 fabricated in the housing side. A portion of the feed conductor is routed along the side 106 lengthwise, and is coupled to the radiator element 108. An antenna cover 118 is disposed directly on top of the radiator 108 so as to provide isolation for the radiator.

The illustrated antenna assembly 230 comprises a rectangular antenna radiator 238 disposed on the housing side 206 and coupled to feed conductor 236 at a feed point (not shown). The feed conductor 236 is fitted through an opening (not shown) fabricated in the housing side 206. A portion of the feed conductor is routed along the side 206 lengthwise, in a way that is similar to the feed conductor 116, and is coupled to the radiator element 238 at a feed point.

In one embodiment, the radiating elements 108, 238 are affixed to the chassis via solder joints at the coupling points (ground and feed. In one variant, the radiating elements are affixed to the device via a conductive sponge at the ground coupling point and to the feed cable via a solder joint at the feed point. In another variant, both connections are effected via a conductive sponge. Other electrical coupling methods are useable with embodiments of the invention including, but not limited to, c-clip, pogo pin, etc. Additionally, a suitable adhesive or mechanical retaining means (e.g., snap fit) may be used if desired to affix the radiating element to the device housing.

The cover elements 118, 240 are in this embodiment also fabricated from any suitable dielectric material (e.g. plastic, glass, zirconia) and are attached to the device housing by a variety of suitable means, such as e.g., adhesive, press-fit, snap-in with support of additional retaining members (not shown), or the like. Alternatively, the covers may be fabricated from a non-conductive film, or non-conductive paint bonded onto one or more exterior surfaces of the radiator element(s) as discussed supra.

A single, multi-feed transceiver may be used to provide feed to both antennas. Alternatively, each antenna may utilize a separate feed, wherein each antenna radiator directly is coupled to a separate feed port of the mobile radio device via a separate feed conductor (similar to that of the embodiment of FIG. 1A) so as to enable operation of each antenna element in a separate frequency band (e.g., lower band, upper band). The device housing/chassis 102 acts as a common ground for both antennas.

FIG. 2B shows another embodiment 250 of the mobile device of the invention, wherein two antenna components 160, 258 are disposed on top and bottom sides of the mobile device housing 102, respectively. Each antenna component 160, 258 is configured similarly to the antenna embodiment depicted in FIG. 1C, and operates in a separate frequency band (e.g., antenna 160 in an upper frequency band and antenna 258 in a lower frequency band). It will further be appreciated that while the embodiments of FIGS. 2A and 2B show two (2) radiating elements each, more radiating elements may be used (such as for the provision of more than two frequency bands, or to accommodate physical features or attributes of the host device). For example, the two radiating elements of each embodiment could be split into two sub-elements each (for a total of four sub-elements), and/or radiating elements could be placed both on the sides and on the top/bottom of the housing (in effect, combining the embodiments of FIGS. 2A and 2B). Yet other variants will be readily appreciated by those of ordinary skill given the present disclosure.

In the embodiment of FIG. 2B, the antenna assemblies 160, 258 are specifically configured to fit in a substantially conformal fashion onto a top or a bottom side of the device housing 252. As the housing 252 comprises a sleeve-like shape, metal support elements 168, 260 are provided. Support elements 168, 260 are shaped to fit precisely into the openings of the housing, and are attached to the housing via any suitable means, such as for example press fit, micro-welding, adhesives, or fasteners (e.g., screws or rivets). The outside surfaces of the support elements 168, 260 are shaped receive the antenna radiators 180 and 268, respectively. The support elements 168, 260 include openings 170, 264, respectively, designed to fit the feed conductors 172, 262. The feed conductors 172, 262 are coupled to the main PCB 256 of the portable device. The device display (not shown) is configured to fit within the cavity 254 formed on the upper surface of the device housing. Antenna cover elements 178, 266 are disposed above the radiators 180, 268 to provide isolation from the exterior influences. In another implementation (not shown) the antenna elements In one variant, the radiating elements 180, 268 are affixed to the respective antenna support elements via solder joints at the coupling points (ground and feed). In another variant, conductive sponge and suitable adhesive or mechanical retaining means (e.g., snap fit, press fit) are used. 160, 258 are configured in a non-conformal arrangement.

As described above, the cover elements 178, 266 may be fabricated from any suitable dielectric material (e.g., plastic, zirconia, or tough glass) and attached to the device housing by any of a variety of suitable means, such as e.g., adhesives, press-fit, snap-in with support of additional retaining members 182, 270, 272

In a different embodiment (not shown), a portion of the feed conductor is routed along a lateral edge of the respective support element (168, 268). To accommodate this implementation, opening 170, 264 are fabricated closer to that lateral edge.

The phone housing or chassis 252 acts as a common ground for both antennas in the illustrated embodiment.

A third embodiment 280 of the mobile device is presented in FIG. 2C, wherein the antenna assemblies 210, 290 are disposed on the left and the bottom sides of the mobile device housing 202, respectively. The device housing 202 comprises a metal enclosure supporting one or more displays 254. Each antenna element of FIG. 2C is configured to operate in a separate frequency band (e.g., antenna 290 in a lower frequency band and antenna 210 in an upper frequency band). Other configurations (e.g., more or less elements, different placement or orientation, etc.) will be recognized by those of ordinary skill given the present disclosure.

The antenna assemblies 210, 290 are constructed similarly to the antenna assembly 210 described above with respect to FIG. 2A. The device housing 202 of the exemplary implementation of FIG. 2C is a metal enclosure with closed sides, therefore not requiring additional support element(s) (e.g., 168) to mount the antenna radiator(s).

In one embodiment, the lower frequency band (i.e., that associated with one of the two radiating elements operating at lower frequency) comprises a sub-GHz Global System for Mobile Communications (GSM) band (e.g., GSM710, GSM750, GSM850, GSM810, GSM900), while the higher band comprises a GSM1900, GSM1800, or PCS-1900 frequency band (e.g., 1.8 or 1.9 GHz).

In another embodiment, the low or high band comprises the Global Positioning System (GPS) frequency band, and the antenna is used for receiving GPS position signals for decoding by e.g., an internal GPS receiver. In one variant, a single upper band antenna assembly operates in both the GPS and the Bluetooth frequency bands.

In another variant, the high-band comprises a Wi-Fi (IEEE Std. 802.11) or Bluetooth frequency band (e.g., approximately 2.4 GHz), and the lower band comprises GSM1900, GSM1800, or PCS1900 frequency band.

In another embodiment, two or more antennas, configured in accordance with the principles of the present invention, operate in the same frequency band thus providing, inter alia, diversity for Multiple In Multiple Out (MIMO) or for Multiple In Single Out (MISO) applications.

In yet another embodiment, one of the frequency bands comprises a frequency band suitable for Near Field Communications applications, e.g., ISM 13.56 MHz band.

Other embodiments of the invention configure the antenna apparatus to cover LTE/LTE-A (e.g., 698 MHz-740 MHz, 900 MHz, 1800 MHz, and 2.5 GHz-2.6 GHz), WWAN (e.g., 824 MHz-960 MHz, and 1710 MHz-2170 MHz), and/or WiMAX (2.3, and 2.5 GHz) frequency bands.

In yet another diplexing implementation (not shown) a single radiating element and a single feed are configured provide a single feed solution that operates in two separate frequency bands. Specifically, a single dual loop radiator forms both frequency bands using a single fee point such that two feed lines (transmission lines 128) of different lengths configured to form two loops, which are joined together at a single diplexing point. The diplexing point is, in turn, coupled to the port of the device via a feed conductor 116.

As persons skilled in the art will appreciate, the frequency band composition given above may be modified as required by the particular application(s) desired. Moreover, the present invention contemplates yet additional antenna structures within a common device (e.g., tri-band or quad-band) with one, two, three, four, or more separate antenna assemblies where sufficient space and separation exists. Each individual antenna assembly can be further configured to operate in one or more frequency bands. Therefore, the number of antenna assemblies does not necessarily need to match the number of frequency bands.

The invention further contemplates using additional antenna elements for diversity/MIMO type of application. The location of the secondary antenna(s) can be chosen to have the desired level of pattern/polarization/spatial diversity. Alternatively, the antenna of the present invention can be used in combination with one or more other antenna types in a MIMO/SIMO configuration (i.e., a heterogeneous MIMO or SIMO array having multiple different types of antennas).

Business Considerations and Methods

An antenna assembly configured according to the exemplary embodiments of FIGS. 1-2C can advantageously be used to enable e.g., short-range communications in a portable wireless device, such as so-called Near-Field Communications (NFC) applications. In one embodiment, the NFC functionality is used to exchange data during a contactless payment transaction. Any one of a plethora of such transactions can be conducted in this manner, including e.g., purchasing a movie ticket or a snack; Wi-Fi access at an NFC-enabled kiosk; downloading the URL for a movie trailer from a DVD retail display; purchasing the movie through an NFC-enabled set-top box in a premises environment; and/or purchasing a ticket to an event through an NFC-enabled promotional poster. When an NFC-enabled portable device is disposed proximate to a compliant NFC reader apparatus, transaction data are exchanged via an appropriate standard (e.g., ISO/IEC 18092/ECMA-340 standard and/or ISO/ELEC 14443 proximity-card standard). In one exemplary embodiment, the antenna assembly is configured so as to enable data exchange over a desired distance; e.g., between 0.1 and 0.5 m.

Performance

Figure 3:
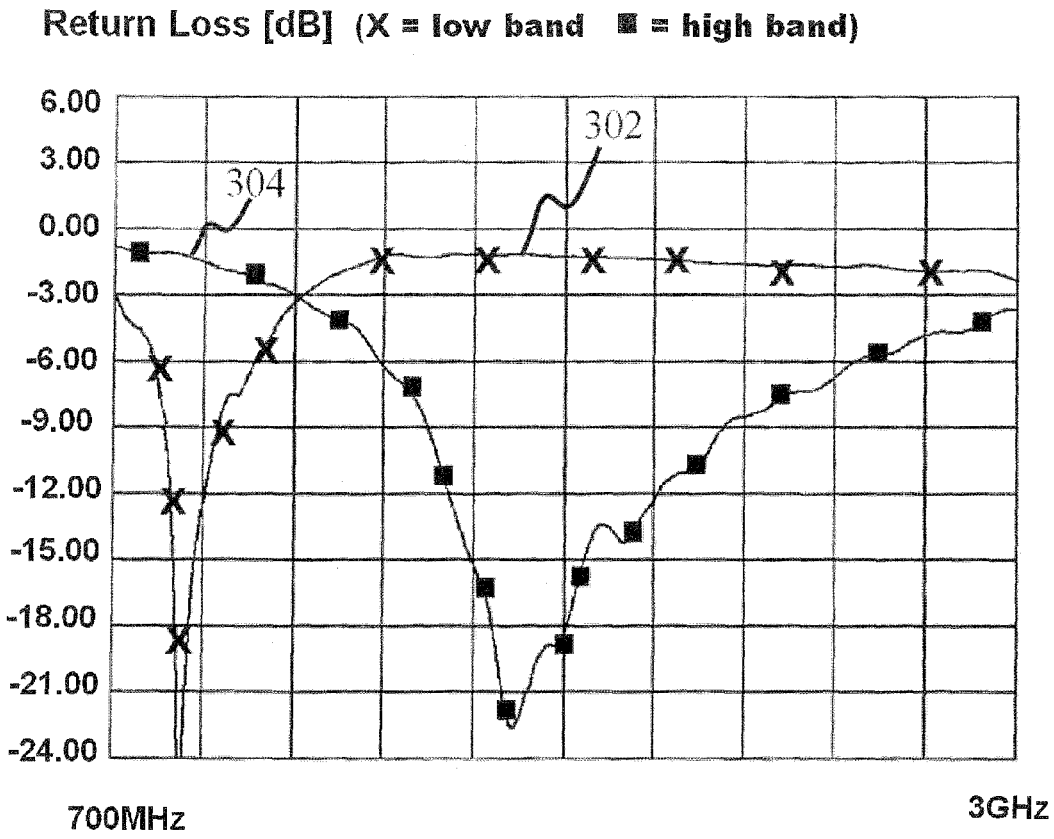
FIG. 3 is a plot of measured free space input return loss for the exemplary lower-band and upper-band antenna elements configured in accordance with the embodiment of FIG. 2C.
Figure 4:
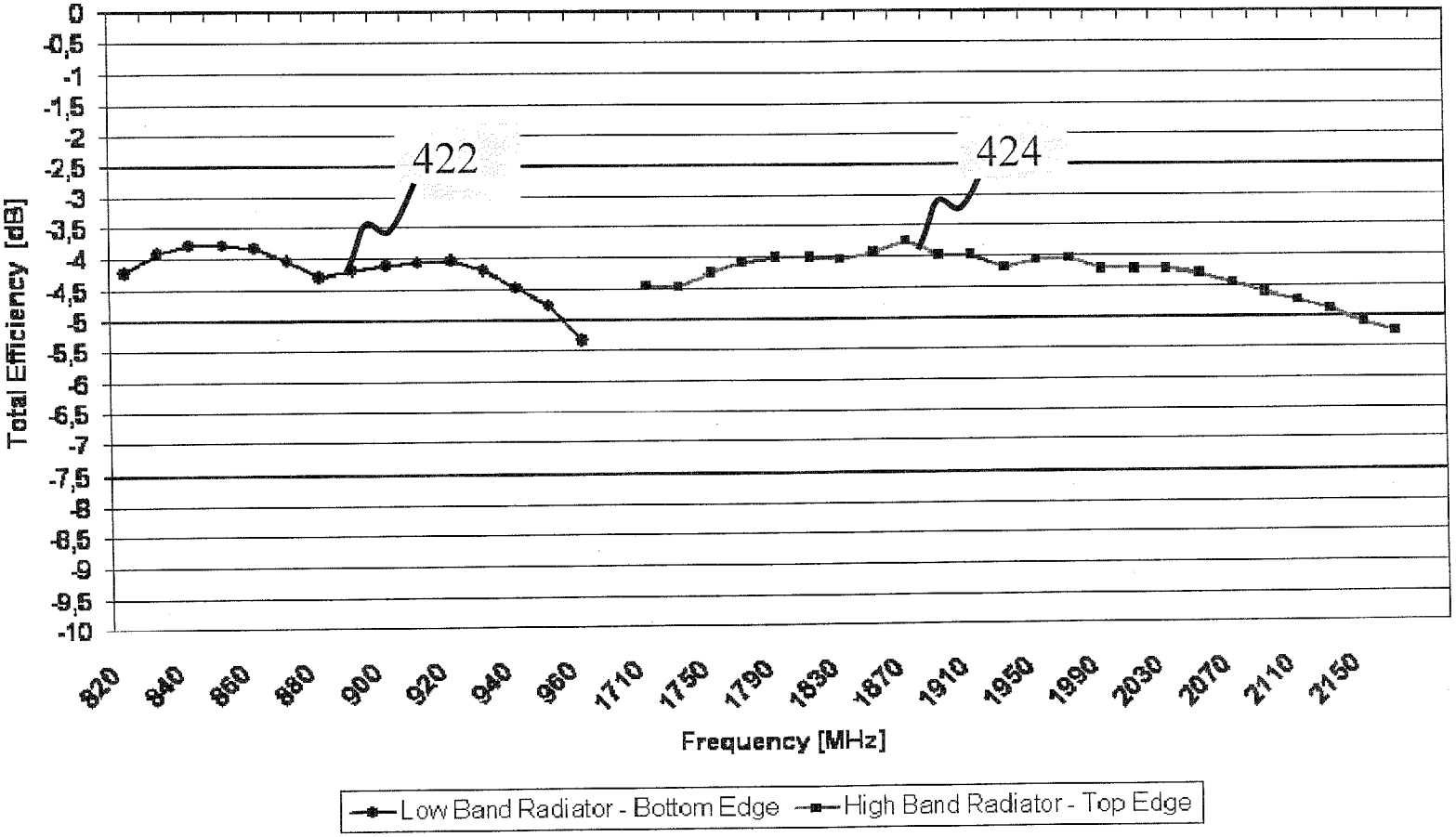
FIG. 4 is a plot of measured total efficiency for the exemplary lower-band and upper-band antenna elements configured in accordance with the embodiment of FIG. 2C.

Referring now to FIGS. 3 through 4, performance results obtained during testing by the Assignee hereof of an exemplary antenna apparatus constructed according invention are presented. The exemplary antenna apparatus comprises separate lower band and upper band antenna assemblies, which is suitable for a dual feed front end. The lower band assembly is disposed along a bottom edge of the device, and the upper band assembly is disposed along a top edge of the device. The exemplary radiators each comprise a PCB coupled to a coaxial feed, and a single ground point per antenna.

FIG. 3 shows a plot of free-space return loss S11 (in dB) as a function of frequency, measured with: (i) the lower-band antenna component 258; and (ii) the upper-band antenna assembly 170, constructed in accordance with the embodiment depicted in FIG. 2B. Exemplary data for the lower (302) and the upper (304) frequency bands show a characteristic resonance structure between 820 MHz and 960 MHz in the lower band, and between 1710 MHz and 2170 MHz for the upper frequency band. Measurements of band-to-band isolation (not shown) yield isolation values of about −21 dB in the lower frequency band, and about −29 dB in the upper frequency band.

FIG. 4 presents data regarding measured free-space efficiency for the same two antennas as described above with respect to FIG. 3. The antenna efficiency (in dB) is defined as decimal logarithm of a ratio of radiated and input power:

$$AntennaEfficiency = 10\log_{10}\left(\frac{\text{Radiated Power}}{\text{Input Power}}\right) \quad \text{Eqn. (1)}$$

An efficiency of zero (0) dB corresponds to an ideal theoretical radiator, wherein all of the input power is radiated in the form of electromagnetic energy. The data in FIG. 4 demonstrate that the lower-band antenna of the invention positioned at bottom side of the portable device achieves a total efficiency (402) between −4.5 and −3.75 dB over the exemplary frequency range between 820 and 960 MHz. The upped band data (404) in FIG. 4, obtained with the upper-band antenna positioned along the top-side of the portable device, shows similar efficiency in the exemplary frequency range between 1710 and 2150 MHz.

The exemplary antenna of FIG. 2B is configured to operate in a lower exemplary frequency band from 700 MHz to 960 MHz, as well as the higher exemplary frequency band from 1710 MHz to 2170 MHz. This capability advantageously allows operation of a portable computing device with a single antenna over several mobile frequency bands such as GSM710, GSM750, GSM850, GSM810, GSM1900, GSM1800, PCS-1900, as well as LTE/LTE-A and WiMAX (IEEE Std. 802.16) frequency bands. As persons skilled in the art appreciate, the frequency band composition given above may be modified as required by the particular application(s) desired, and additional bands may be supported/used as well.

Advantageously, an antenna configuration that uses the distributed antenna configuration as in the illustrated embodiments described herein allows for optimization of antenna operation in the lower frequency band independent of the upper band operation. Furthermore, the use of coupled loop chassis excited antenna structure reduces antenna size, particularly height, which in turn allows for thinner portable communication devices. As previously described, a reduction in thickness can be a critical attribute for a mobile wireless device and its commercial popularity (even more so than other dimensions in some cases), in that thickness can make the difference between something fitting in a desired space (e.g., shirt pocket, travel bag side pocket, etc.) and not fitting.

Moreover, by fitting the antenna radiator(s) flush with the housing side, a near 'zero volume' antenna is created. At the same time, antenna complexity and cost are reduced, while robustness and repeatability of mobile device antenna manufacturing and operation increase. The use of zirconia or tough glass materials for antenna covers in certain embodiments described herein also provides for an improved aesthetic appearance of the communications device and allows for decorative post-processing processes.

Advantageously, a device that uses the antenna configuration as in the illustrated embodiments described herein allows the use of a fully metal enclosure (or metal chassis) if desired. Such enclosures/chassis provide a robust support for the display element, and create a device with a rigid mechanical construction (while also improving antenna operation). These features enable construction of thinner radio devices (compared to presently available solutions, described above) with large displays using fully metal enclosures.

Experimental results obtained by the Assignee hereof verify a very good isolation (e.g., −21 dB) between an antenna operating in a lower band (e.g., 850/900 MHz) and about −29 dB for an antenna operating an upper band (1800/1900/2100 MHz) in an exemplary dual feed configuration. The high isolation between the lower band and the upper band antennas allows for a simplified filter design, thereby also facilitating optimization of analog front end electronics.

In an embodiment, several antennas constructed in accordance with the principles of the present invention and operating in the same frequency band are utilized to construct a multiple in multiple out (MIMO) antenna apparatus.

It will be recognized that while certain aspects of the invention are described in terms of a specific sequence of steps of a method, these descriptions are only illustrative of the broader methods of the invention, and may be modified as required by the particular application. Certain steps may be rendered unnecessary or optional under certain circumstances. Additionally, certain steps or functionality may be added to the disclosed embodiments, or the order of performance of two or more steps permuted. All such variations are considered to be encompassed within the invention disclosed and claimed herein.

While the above detailed description has shown, described, and pointed out novel features of the invention as applied to various embodiments, it will be understood that various omissions, substitutions, and changes in the form and details of the device or process illustrated may be made by those skilled in the art without departing from the invention. The foregoing description is of the best mode presently contemplated of carrying out the invention. This description is in no way meant to be limiting, but rather should be taken as illustrative of the general principles of the invention. The scope of the invention should be determined with reference to the claims.

What is claimed is:

1. An antenna component for use in a portable communications device, the device comprising a ground, a feed port, and a metal structure having a plurality of sides, said component comprising:

a radiator element having a first dimension and a second dimension, a first and second surface, and configured to be disposed proximate to a first side of said plurality of sides;

a dielectric substrate having a third dimension and a fourth dimension, and configured to be disposed proximate the second surface;

a feed conductor configured to couple to the radiator element at a feed point; and a dielectric element disposed between the radiator element and the first side and configured to electrically isolate at least a portion of the first side from the radiator element.

2. The antenna component of claim 1, wherein:

a normal projection of the dielectric substrate is equal or larger than a normal projection of the radiator element; and the radiator element is electrically coupled to the ground at a ground point.

3. The antenna component of claim 2, wherein at least a portion of the feed conductor is arranged along the first side substantially parallel to the first dimension; and the radiator element, the at least a portion of the feed conductor, and at least a portion of the first side form a coupled loop antenna operable in a first frequency band.

4. The antenna component of claim 1, wherein the radiator element comprises a conductive structure comprising a first portion and a second portion, wherein the second portion is coupled to the feed point via a reactive circuit.

5. The antenna component of claim 4, further comprising a dielectric element disposed between the radiator element and the first side and configured to electrically isolate at least a portion of the first side from the radiator element.

6. The antenna component of claim 4, wherein the reactive circuit comprises a planar transmission line.

7. The antenna component of claim 4, wherein the second portion further comprises a second reactive circuit, configured to adjust electrical size of the radiator element.

8. The antenna component of claim 7, wherein the second reactive circuit comprises at least one of (i) an inductive element, and/or (ii) a capacitive element.

9. The antenna of claim 4, wherein the radiator element comprises a dielectric substrate, and a conductive coating disposed thereon; and the conductive structure comprises the conductive coating.

10. The antenna component of claim 1, wherein the metal structure comprises a sleeve like shape having at least a first cavity; and the first side comprises a metal support element disposed within the first cavity.

11. The antenna component of claim 1, wherein at least a portion of the feed conductor is arranged along the first side substantially parallel to the first dimension; and the radiator element, the at least a portion of the feed conductor, and at least a portion of the first side form a coupled loop antenna operable in a first frequency band.

12. The antenna of claim 1, wherein the radiator element comprises a dielectric substrate, and a conductive coating disposed thereon.

13. The antenna of claim 1, wherein the radiator element comprises a flex circuit.

14. An antenna apparatus for use in a portable communications device comprising a metal enclosure having a plurality of sides and housing an electronics comprising a ground and at least one feed port, said antenna apparatus comprising:

a first antenna assembly configured to operate in a first frequency band, the first assembly comprising:

a first radiator element comprising a first ground point and a first feed point, and disposed along a first of the plurality of sides;

a first feed conductor coupled to the first feed point and to the at least one feed port; and a first non-conductive cover disposed proximate the first radiator so as to substantially cover the first radiator; and a second antenna assembly configured to operate in a second frequency band, the second assembly comprising:

a second radiator element comprising a second ground point and a second feed point, disposed along a second of the plurality of sides;

a second feed conductor coupled to the second feed point and to a feed port; and a second non-conductive cover disposed proximate the second radiator so as to substantially cover the second radiator;

wherein the first of the plurality of sides is arranged substantially opposite from the second of the plurality of sides.

15. The antenna apparatus of claim 14, wherein:

the metal enclosure is electrically coupled to the ground, to the first ground point, and to the second ground point;

at least a portion of a first feed cable is disposed along the first side thereby forming a first coupled loop antenna structure between at least a portion of the metal enclosure, the first radiator element, and the at least a portion of the first feed cable; and at least a portion of a second feed cable is disposed along the second side thereby forming a second coupled loop antenna structure between at least a portion of the metal enclosure, the second radiator element, and the at least a portion of the second feed cable.

16. The antenna apparatus of claim 15, wherein the first and second radiator elements are disposed substantially between the first and second covers, respectively, and the metal enclosure.

17. The antenna apparatus of claim 16, further comprising a dielectric element disposed between the radiator element and the first side and configured to electrically isolate at least a portion of the first side from the radiator element.

18. The antenna apparatus of claim 14, wherein the first and second radiator elements are disposed substantially between the first and second covers, respectively, and the metal enclosure.

19. The antenna of claim 14, wherein the first frequency band comprises a frequency band between 700 and 960 MHz and the second frequency band comprised an upper frequency band.

20. The antenna of claim 19, wherein the upper frequency band comprises frequency band between 1710 and 2150 MHz.

21. The antenna of claim 19, wherein the upper frequency band comprises a global positioning system (GPS) frequency band.

22. The antenna of claim 14, wherein the feed port comprises the at least one feed port.

23. The antenna apparatus of claim 14, wherein the metal enclosure comprises a sleeve like shape having a first cavity and a second cavity; and the first side comprises a first metal support element disposed within the first cavity and configured to receive the first radiator element; and the second side comprises a second metal support element disposed within the second cavity and configured to receive the second radiator element.

24. An antenna component comprising:

a dielectric substrate having a plurality of surfaces;

a conductive coating disposed on at least one surface of the substrate, the conductive coating configured to form:

at least a portion of a ground plane, comprising a ground point;

a radiator structure comprising:

a feed;

a first portion;

a second portion;

a stripline coupled from said second portion to said feed point; and a plurality of non conductive slots isolating substantially separating the strip line from the first portion; and at least one ground clearance area disposed substantially within perimeter of the a t least one surface;

wherein the ground point is configured to couple the at least a portion of the ground plane to a ground of a host device; and wherein the second portion is coupled to the first portion via a conductive element.

25. The antenna component of claim 24, wherein the second portion is further coupled to the first portion via a reactive circuit.

26. The antenna component of claim 25, wherein the reactive circuit comprises at least one of (i) an inductive element, and/or (ii) a capacitive element.

27. A mobile communications device, comprising:

a substantially metallic exterior housing comprising a plurality of sides;

an electronics assembly contained substantially therein and comprising a ground and at least one feed port;

a first antenna assembly configured to operate in a first frequency band, the first assembly comprising:

a first radiator element comprising a first ground point and a first feed point, and disposed along a first of the plurality of sides;

a first feed conductor coupled to the first feed point and to the at least one feed port; and a first non-conductive cover disposed proximate the first radiator so as to substantially cover the first radiator; and a second antenna assembly configured to operate in a second frequency band, the second assembly comprising:

a second radiator element comprising a second ground point and a second feed point, disposed along a second of the plurality of sides;

a second feed conductor coupled to the second feed point and to a feed port; and a second non-conductive cover disposed proximate the second radiator so as to substantially cover the second radiator;

wherein:

the first ground point and the second ground point are electrically coupled to the metal housing;

a first coupled loop resonance structure is formed between at least a portion of the housing, the first radiator, and at least a portion of the first feed cable; and a second coupled loop resonance structure is formed between at least a portion of the housing, the second radiator, and at least a portion of the second feed cable.

* * * * *